US007722461B2

(12) United States Patent
Gatto et al.

(10) Patent No.: US 7,722,461 B2
(45) Date of Patent: May 25, 2010

(54) METHOD AND SYSTEM FOR TIME GAMING WITH SKILL WAGERING OPPORTUNITIES

(75) Inventors: Jean-Marie Gatto, London (GB); Thierry Brunet De Courssou, Henderson, NV (US)

(73) Assignee: IGT, Reno, NV (US)

( * ) Notice: Subject to any disclaimer, the term of this patent is extended or adjusted under 35 U.S.C. 154(b) by 298 days.

(21) Appl. No.: 11/457,137

(22) Filed: Jul. 12, 2006

(65) Prior Publication Data

US 2008/0015004 A1 Jan. 17, 2008

(51) Int. Cl.
*A63F 9/24* (2006.01)

(52) U.S. Cl. ..... 463/25; 463/1; 463/7; 463/16

(58) Field of Classification Search ..... 463/25, 463/1, 7–20, 42
See application file for complete search history.

(56) References Cited

U.S. PATENT DOCUMENTS

| | | | |
|---|---|---|---|
| 4,593,904 | A | 6/1986 | Graves |
| 4,695,053 | A | 9/1987 | Vazquez, Jr. et al. |
| 5,265,874 | A | 11/1993 | Dickinson et al. |
| 5,280,909 | A | 1/1994 | Tracy |
| 5,290,033 | A | 3/1994 | Bittner et al. |
| 5,342,049 | A | 8/1994 | Wichinsky et al. |
| 5,354,202 | A | 10/1994 | Moncrief et al. |
| 5,743,523 | A | 4/1998 | Kelly et al. |
| 5,816,913 | A | 10/1998 | Nakamura |
| 5,823,873 | A | 10/1998 | Moody |
| 5,890,963 | A | 4/1999 | Yen |
| 5,910,046 | A | 6/1999 | Wada et al. |
| 6,012,983 | A | 1/2000 | Walker et al. |
| 6,019,374 | A | 2/2000 | Breeding |
| 6,048,269 | A | 4/2000 | Burns et al. |
| 6,050,895 | A | 4/2000 | Luciano, Jr. et al. |
| 6,077,163 | A | 6/2000 | Walker et al. |
| 6,146,273 | A | 11/2000 | Olsen |

(Continued)

FOREIGN PATENT DOCUMENTS

WO WO 01/41892 A2 6/2001

OTHER PUBLICATIONS

McGehee, Brad, "An Introduction to SQL Clustering" [online], Jun. 24, 2001, [retrieved Jun. 29, 2005, from http://www.sql-server-performance.com/clustering_introl1asp.

(Continued)

*Primary Examiner*—Scott Jones
(74) *Attorney, Agent, or Firm*—Young Law Firm, P.C.

(57) ABSTRACT

A method and system for players to purchase a time credit, play a vibrant console type skill game and place countless numbers of bets until the time credit has elapsed. A two-player console type skill game allows two players to enter a fierce challenge and place countless numbers of bets until the time credit has elapsed. Wherever gaming regulation allows time-gaming AutoBet, then the bet outcome result (instead of fixed points) is briefly shown and accumulated each time a winning or losing feature is hit along the play path; otherwise a "BET" or "No Bet" prompt confirms that a betting opportunity has been offered and requests that the player confirm his or her intention to place the bet.

94 Claims, 16 Drawing Sheets

U.S. PATENT DOCUMENTS

| | | | |
|---|---|---|---|
| 6,171,186 | B1 | 1/2001 | Kurosawa et al. |
| 6,179,713 | B1 | 1/2001 | James et al. |
| 6,182,086 | B1 | 1/2001 | Lomet et al. |
| 6,244,957 | B1 | 6/2001 | Walker et al. |
| 6,267,669 | B1 | 7/2001 | Luciano, Jr. et al. |
| 6,283,474 | B1 | 9/2001 | de Keller |
| 6,409,597 | B1 | 6/2002 | Mizumoto |
| 6,425,823 | B1 | 7/2002 | Byrne |
| 6,428,413 | B1 | 8/2002 | Carlson |
| 6,517,433 | B2 | 2/2003 | Loose et al. |
| 6,522,312 | B2 | 2/2003 | Ohshima et al. |
| 6,749,510 | B2 | 6/2004 | Giobbi |
| 6,761,632 | B2 | 7/2004 | Bansemer et al. |
| 6,761,636 | B2 | 7/2004 | Chung et al. |
| 6,811,482 | B2 | 11/2004 | Letovsky |
| D535,338 | S | 1/2007 | Linard et al. |
| 7,291,070 | B2 | 11/2007 | Gatto et al. |
| 7,371,173 | B2 | 5/2008 | Gatto et al. |
| 2002/0128065 | A1 | 9/2002 | Chung et al. |
| 2002/0147040 | A1 | 10/2002 | Walker et al. |
| 2003/0171140 | A1 | 9/2003 | Gatto et al. |
| 2003/0211881 | A1 | 11/2003 | Walker et al. |
| 2004/0102238 | A1 | 5/2004 | Taylor |
| 2005/0148377 | A1* | 7/2005 | Goldberg et al. ..... 463/12 |
| 2005/0192087 | A1* | 9/2005 | Friedman et al. ..... 463/25 |
| 2006/0281509 | A1 | 12/2006 | Arias-Vargas et al. |
| 2007/0142108 | A1 | 6/2007 | Linard et al. |

OTHER PUBLICATIONS

International Search Report mailed Aug. 2, 2005, in related International Application No. PCT/US04/28935, filed Sep. 2, 2004.

Written Opinion mailed Aug. 2, 2005, in related International Application No. PCT/US04/28935, filed Sep. 2, 2004.

RSA Security, Brochure entitled, "RSA BSAFE Crypto-C Cryptographic components for C".

Intel Corporation, Intel Platform Security Division, "The Intel Random Number Generator", pp. 1-12, 1999.

International Preliminary Report on Patentability mailed Jan. 13, 2005, in related International Application No. PCT/US04/28935, filed Sep. 2, 2004.

International Preliminary Report on Patentability of Jan. 22, 2009 in related International Application PCT/US2007/071813 (8 pages).

International Search Report in corresponding PCT case PCT/US07/71813, mailed Oct. 2, 2008.

Written Opinion of the International Searching Authority in corresponding PCT case PCT/US07/71813, mailed Oct. 2, 2008.

* cited by examiner

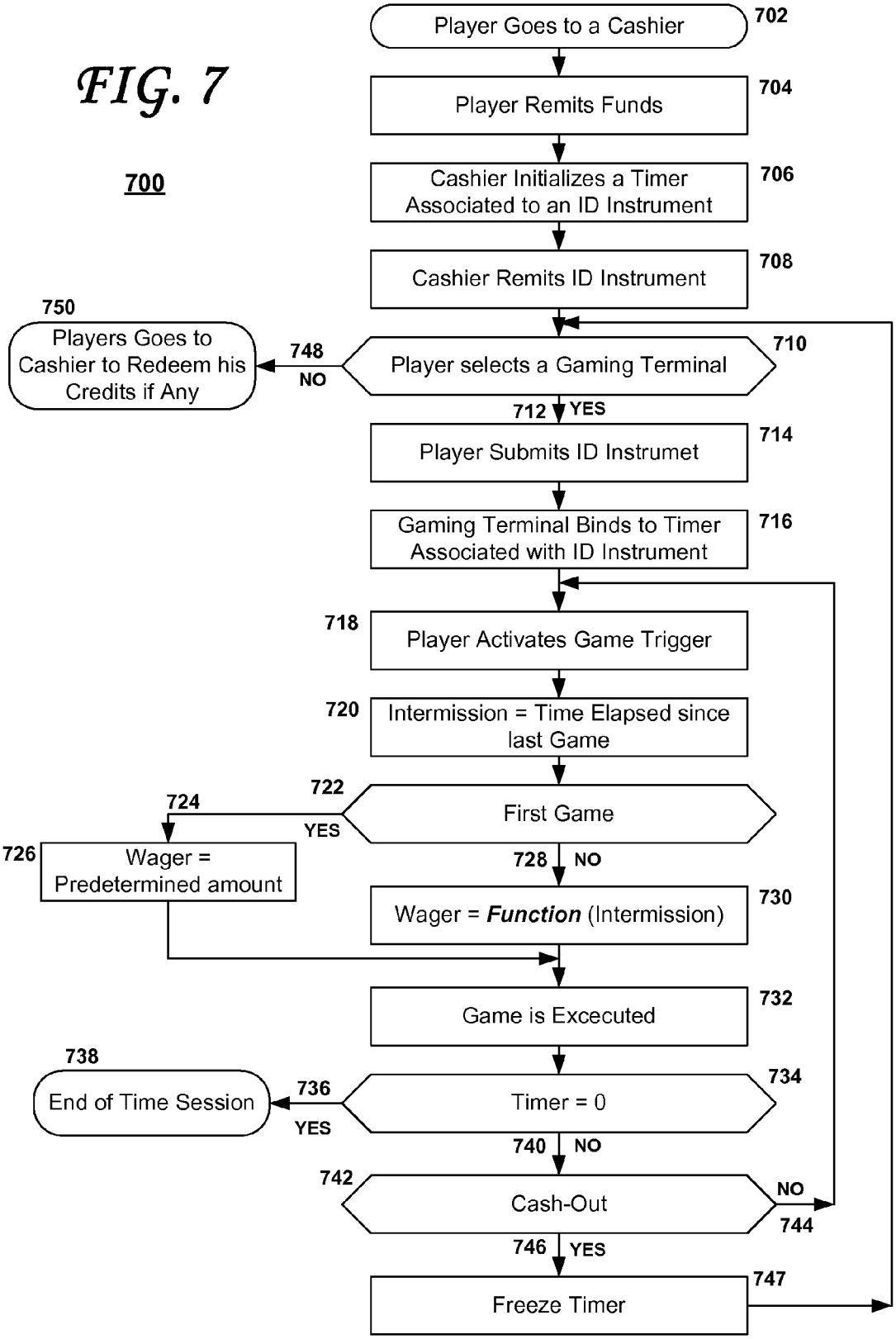
FIG. 7
700
Player Goes to a Cashier
702
Player Remits Funds
704
Cashier Initializes a Timer Associated to an ID Instrument
706
Cashier Remits ID Instrument
708
750
Players Goes to Cashier to Redeem his Credits if Any
748
NO
Player selects a Gaming Terminal
710
712
YES
Player Submits ID Instrumet
714
Gaming Terminal Binds to Timer Associated with ID Instrument
716
718
Player Activates Game Trigger
720
Intermission = Time Elapsed since last Game
722
724
YES
First Game
726
Wager = Predetermined amount
728
NO
Wager = Function (Intermission)
730
Game is Excecuted
732
738
End of Time Session
736
YES
Timer = 0
734
740
NO
742
Cash-Out
NO
744
746
YES
Freeze Timer
747

METHOD AND SYSTEM FOR TIME GAMING WITH SKILL WAGERING OPPORTUNITIES

BACKGROUND OF THE INVENTION

1. Field of the Invention

This invention relates generally to the field of electronic gaming terminals available in casinos and other legal places.

2. Description of the Prior Art and Related Information

Electronic gaming machines available in casinos and other legal places are games of chance whereby the player repetitively tries his luck to win prizes. The player purchases an amount of credit to play by transferring monetary value into the gaming machine or into the networked gaming system using coins, banknotes, vouchers or any other form of financial instrument. In exchange for his money, the player is given an electronic credit on a local gaming machine or alternatively on a networked gaming system by way of a player account managed on a server. Each time the player plays a game, his credit balance is debited of the amount he wishes to wager. Depending on the local game regulation, the wager amount is either hardwired into the gaming machine or selectable by the user prior to playing a game. The play-and-debit scenario is typically repeated monotonously until the player's credit is used up or until a prize is won. The prize value is derived from numbers drawn randomly, an outcome prize matrix and the wager amount.

SUMMARY OF THE INVENTION

According to an embodiment thereof, the present invention is a method for enabling game play on a gaming machine. The method may include steps of modifying an existing console-type game or arcade-type game such that a plurality of wagering opportunities arise during the course of game play, the arising of the wagering opportunities being dependent upon the player's skill; activating a game session on the gaming machine with a credit of playing time, the game session enabling the player to play the modified console-type game or arcade-type game for an amount of time determined by the credit of playing time; enabling the player to place a bet on at least one of the plurality of wagering opportunities during the game play, and determining an outcome of the placed bet randomly.

According to further embodiments, the amount of the bet may be dependent upon a time elapsed since a last bet was placed. The outcome amount of the placed bet may be dependent upon the time elapsed since a last bet was placed. The method may also include a step of enabling the player to select an amount of the bet. The amount of the bet selected by the player may be debited from a credit account credited from a selected one of a cash acceptor, a cashless ticket-in reader and a bonus awarded and credits won in the course of a time game.

The enabling step further may include a step of receiving input from the player, the received input from the player indicating whether the player wishes to place the bet or wishes to decline to place the bet. The bet may be placed automatically by the gaming machine in an amount that is dependent upon an elapsed time since a last bet was placed. The bet may be placed automatically by the gaming machine in an amount that may be pre-selected by the player. The enabling step may enable the player to place the bet until a timeout period has elapsed. The timeout period may be selected by the player. The game session may terminate when the credit of playing time is exhausted. Any remaining credit of playing time may be frozen when the player actuates a cash-out event. The modifying step may include adding wagering opportunities for selected game events that would otherwise cause points to be awarded or taken away during game play of the existing console-type or arcade-type game. The modifying step may be carried out with the existing game console-type being a game configured for game play on a game console from, for example, Sony Microsoft or Nintendo, to identify but a few possibilities. The game session activating step may be carried out with the game session enabling a plurality of players to play the modified console-type game or arcade-type game in a multi-player mode. The game session of respective ones of the plurality of players may last for an amount of time determined by respective credits of playing time of the plurality of players. The enabling step may include a step of requiring the player to confirm whether the player wishes to place the bet or wishes to decline to place the bet. The modifying step may be carried out with the existing console-type game or arcade-type game being an at least partially skill-based game.

According to another embodiment thereof, the present invention is a method for enabling game play on a gaming machine. The method may include steps of configuring a skill-based game such that a plurality of wagering opportunities arise during the course of game play, the arising of the wagering opportunities being dependent upon the player's skill; activating a game session on the gaming machine with a credit of playing time, the game session enabling the player to play the skill-based console-type game or arcade-type game for an amount of time determined by the credit of playing time; enabling the player to place a bet on at least one of the plurality of wagering opportunities during the game play, and determining an outcome of the placed bet randomly.

The amount of the bet may be dependent upon, for example, a time elapsed since a last bet was placed. The outcome amount of the placed bet may be dependent upon a time elapsed since a last bet was placed. The method may also include a step of enabling the player to select the amount of the bet. The amount of the bet selected by the player may be debited from a credit account credited from a cash acceptor, a cashless ticket-in reader, and a bonus awarded and credits won in the course of a time game, for example.

The enabling step further may include a step of receiving input from the player, the received input from the player indicating whether the player wishes to place the bet or wishes to decline to place the bet. The bet may be placed automatically by the gaming machine in an amount is dependent upon an elapsed time since a last bet was placed. The bet may be placed automatically by the gaming machine in an amount that may be pre-selected by the player. The enabling step may enable the player to place the bet until a timeout period has elapsed. The timeout period may be selected by the player. The game session may terminate when the credit of playing time is exhausted. Any remaining credit of playing time may be frozen when the player actuates a cash-out event. The modifying step may include adding wagering opportunities for selected ones of game events that would otherwise cause points to be awarded or taken away during game play of the console-type or arcade-type game. The modifying step may be carried out with the skill-based game console-type being a game configured for game play on a game console from Sony, Microsoft or Nintendo, for example. The game session activating step may be carried out with the game session enabling a plurality of players to play the modified skill based console-type game or arcade-type game in a multi-player mode. The game session of respective ones of the plurality of players may last for an amount of time determined by respective credits of playing time of the plurality of players. The enabling step may include a step of requiring the player to confirm whether the player wishes to place the bet or wishes to decline to place the bet.

According to yet another embodiment, the present invention is a gaming machine, comprising a modified existing console-type game or arcade-type game, configured such that a plurality of wagering opportunities arise during the course of game play, the arising of the wagering opportunities being dependent upon the player's skill; a computer, configured for enabling a game session with a purchased credit of playing time, for running the modified existing console-type game or arcade-type game, for enabling player interactivity with the modified existing console-type game or arcade-type game and for enabling a player to place at least one bet when the wagering opportunities arise during game play of the modified existing console-type game or arcade-type game; a source of random numbers coupled to the computer, for randomly determining an outcome of the placed bet, and a timer coupled to the computer, configured for determining a remaining amount of the credit of playing time, the game session ending when the remaining amount of the credit of playing time is exhausted.

The existing console-type game or arcade-type game may be modified such that the plurality of wagering opportunities arise when selected game events occur that would otherwise cause points to be awarded or taken away during game play of the existing console-type or arcade-type game. The modified existing console-type game or arcade-type game may be configured such that amount of the at least one placed bet is dependent upon a time elapsed since a last bet was placed. The outcome amount of the place bet may be dependent upon a time elapsed since a last bet was placed. The modified existing console-type game or arcade-type game may be configured to enable the player to select an amount of the at least one bet. The amount of the bet selected by the player may be debited from a credit account credited from a cash acceptor, a cashless ticket-in reader, and a bonus awarded and credits won in the course of a time game, for example. The modified existing console-type game or arcade-type game may be configured to receive input from the player, the received input from the player indicating whether the player wishes to place the bet or wishes to decline to place the bet. The computer may be further configured such that the enabling step enables the player to place the bet until a timeout period has elapsed. The timeout period may be selected by the player. The modified existing console-type game or arcade-type game may be configured to automatically place the at least one bet in an amount is dependent upon an elapsed time since a last bet was placed. The modified existing console-type game or arcade-type game may be configured to place the at least one bet automatically in an amount that may be pre-selected by the player. The modified existing console-type game or arcade-type game may be a game configured for game play on a game console selected from Sony, Microsoft, Nintendo or Bally, for example. The modified existing console-type game or arcade-type game may be a game configured for multi-player gaming and the game session the game session may be configured to enable a plurality of players to play the modified console-type game or arcade-type game in a multi-player mode. The game session of respective ones of the plurality of players may last for an amount of time determined by respective credits of playing time of the plurality of players. The modified existing console-type game or arcade-type game may be configured to require the player to confirm whether the player wishes to place the bet or wishes to decline to place the bet. The bet may be automatically declined after a timeout period, which may be selected by the player. The modified existing console-type game or arcade-type game may be configured as an at least partially skill-based game. The source of random numbers, for randomly determining an outcome of the placed bet may include a random number generator within the gaming machine. Alternatively, the source of random numbers, for randomly determining an outcome of the placed bet may include a network connection for receiving game outcomes from a server coupled to a network.

According to still another embodiment thereof, the present invention is a gaming machine including a skill-based game configured such that a plurality of wagering opportunities arise during the course of game play, the arising of the wagering opportunities being dependent upon the player's skill; a computer, configured for enabling a game session with a purchased credit of playing time, for running the skill-based game, for enabling player interactivity with the skill-based game and for enabling a player to place at least one bet when the wagering opportunities arise during game play of the skill-based game; a source of random numbers, coupled to the computer, for randomly determining an outcome of the placed bet, and a timer coupled to the computer, for determining a remaining amount of the credit of playing time, the game session ending when the remaining amount of the credit of playing time is exhausted.

The skill-based game may be modified such that the plurality of wagering opportunities arise when selected game events occur that would otherwise cause points to be awarded or taken away during game play of the skill-based game. The skill-based game may be configured such that amount of the placed bet(s) may be dependent upon the time elapsed since a last bet was placed. The outcome amount of the placed bet may be dependent upon the time elapsed since a last bet was placed. The skill-based game may be configured to enable the player to select the amount of the bet(s). The amount of the bet selected by the player may be debited from a credit account credited from a cash acceptor, a cashless ticket-in reader, or a bonus awarded and credits won in the course of a time game, for example. The skill-based game may be configured to receive input from the player, the received input from the player indicating whether the player wishes to place the bet or wishes to decline to place the bet. The computer may be configured such that the bet is automatically declined after a timeout period. The timeout period may be player selectable. The skill-based game may be configured to automatically place the bet(s) in an amount is dependent upon an elapsed time since a last bet was placed. The skill-based game may be configured to place the bet(s) automatically in an amount that may be pre-selected by the player. The amount of the bet pre-selected by the player may be debited from a credit account credited from a cash acceptor, a cashless ticket-in reader, or a bonus awarded and credits won in the course of a time game, for example. The skill-based game may be a game configured for game play on a game console from Sony, Microsoft or Nintendo, to identify but a few of the possible sources of such game console and source of arcade games. The skill-based game may be a game configured for multi-player gaming and the game session the game session may be configured to enable a plurality of players to play the skill-based game in a multi-player mode. The game session of respective ones of the plurality of players may last for an amount of time determined by respective credits of playing time of the plurality of players. The skill-based game may be configured to require the player to confirm whether the player wishes to place the bet or wishes to decline to place the bet. The computer may be further configured such that the bet may be automatically declined after a timeout period, which may be selected by the player. The source of random numbers, for randomly determining an outcome of the placed bet may include a random number generator within the gaming machine. Alternatively, the source of random numbers, for randomly determining an outcome of the placed bet may include a network connection for receiving game outcomes from a server coupled to a network.

According to still another embodiment thereof, the present invention is a method for enabling game play on a gaming machine, comprising the steps of activating a game session on the gaming machine with a credit of playing time, the game session enabling the player to play a primary game of chance for an amount of time determined by the credit of playing time; enabling primary wagers to be placed on the primary game during the game session; for each primary wager placed and won, determining an amount of credits due to the player as a function of an elapsed time since a previous primary wager was placed during the game session; occasionally halting game play on the primary game upon occurrence of a predetermined event within the primary game and offering one or more contextually driven additional wagering opportunities of limited duration, and re-enabling game play on the primary game when the limited duration has elapsed or when the player has availed him or herself of the additional gaming opportunity. The credit of playing time may be controlled by a down-counting timer and the method further may include ending the game session when the down-counting timer reaches a predetermined number. The credit of playing time may be controlled by an up-counting timer and the method further may include ending the game session when the up-counting timer reaches a predetermined number. The game session may terminate when the credit of playing time is exhausted. Any remaining credit of playing time may be frozen when game play on the primary game is halted and unfrozen when game play on the primary game is re-enabled. Any remaining credit of playing time may continue to decrement when game play on the primary game is halted and when play on the primary game is re-enabled. Any remaining credit of playing time may be frozen when the player actuates a cash-out event. The additional wagering opportunity may be offered more infrequently each time the player declines to avail him or herself of the offered additional wagering opportunity. The primary game play may be re-enabled as of a point where the primary game play was halted to offer the additional wagering opportunity. The primary game play may be re-enabled at a different point in the primary game than where the primary game was halted to offer the additional wagering opportunity. The contextually driven additional wagering opportunities offered may be dependent upon the state of the primary game as of the time when game play on the primary game was halted. A step of offering at least one contextually driven additional wagering opportunity when one or more predetermined events occur external to the gaming machine may be carried. The method may further include an initial step of dispensing to the player an ID instrument associated with the amount of playing time purchased by the player, the ID instrument being submitted to the gaming machine to activate the game session. The offering step may be configured to offer to the player one or more contextually driven additional wagering opportunities that may be structured based upon player data associated with a loyalty card of the player. The offering step may be configured to offer to the player one or more contextually driven additional wagering opportunities that may be structured based upon at least one of a past performance and behavior of the player.

According to another embodiment, the present invention is a method for a player to wager on a gaming machine. The method may include steps of activating a game session on the gaming machine with a credit of playing time, the game session enabling the player to play primary games of chance for an amount of time determined by the credit of playing time; enabling successive primary games to be triggered during the game session; determining an amount of the wager for each game played during the game session as a function of an elapsed time since a triggering of a previous game played during the game session; occasionally halting game play of a primary game being played upon occurrence of a predetermined event within the primary game and offering to the player one or more contextually driven additional wagering opportunities of limited duration, and re-enabling game play on the primary game when the limited duration has elapsed or when the player has availed him or herself of the additional gaming opportunity.

The credit of playing time may be controlled by a down-counting timer and the method further may include ending the game session when the down-counting timer reaches a predetermined number. Alternatively, the credit of playing time may be controlled by an up-counting timer and the method further may include ending the game session when the up-counting timer reaches a predetermined number. The game session may terminate when the credit of playing time is exhausted. Any remaining credit of playing time may be frozen when game play on the primary game is halted and unfrozen when game play on the primary game is re-enabled. Any remaining credit of playing time may continue to decrement when game play on the primary game is halted and when play on the primary game is re-enabled. Any remaining credit of playing time may be frozen when the player actuates a cash-out event. The additional wagering opportunity may be offered more infrequently each time the player declines to avail him or herself of the offered additional wagering opportunity. The primary game play may be re-enabled as of a point where the primary game play was halted to offer the additional wagering opportunity. The primary game play may be re-enabled at a different point in the primary game than where the primary game was halted to offer the additional wagering opportunity. The contextually driven additional wagering opportunities offered may be dependent upon the state of the primary game as of a time when game play on the primary game was halted. The method may include an initial step of dispensing to the player an ID instrument associated with the amount of playing time purchased by the player, the ID instrument being submitted to the gaming machine to activate the game session. The offering step may be configured to offer to the player one or more contextually driven additional wagering opportunities that may be structured based upon player data associated with a loyalty card of the player. The offering step may be configured to offer to the player one or more contextually driven additional wagering opportunities that may be structured based upon at least one of a past performance and behavior of the player.

Yet another embodiment of the present invention is a gaming machine, comprising a primary game, the primary game comprising a plurality of primary wagering opportunities for a player of the gaming machine, the primary game being active for a predetermined period of time determined by a credit of playing time purchased by the player, and a plurality of additional wagering opportunities that may be unrelated to the primary wagering opportunities, each of the plurality of additional wagering opportunities being contextually triggered and made available to the player by respective predetermined events occurring within the primary game during the game session.

The gaming machine may further include a first display and a second display and the primary game may be displayed on the first display and the plurality of additional wagering opportunities may be displayed in the second display. The gaming machine may further include a single display and both the primary game and the plurality of additional wagering opportunities may be displayed on the single display. One or more of the plurality of additional wagering opportunities may be displayed on the single display as a pop-up window (for example) over the primary game. A timer may be provided and each of the additional wagering opportunities may be displayed for the player for a limited period of time determined by the timer. The primary game may be configured to be halted when any of the plurality of additional wagering opportunities are contextually triggered and made available to the player and re-enabled when the limited period of time is exhausted. Any remaining credit of playing time may be frozen when game play on the primary game is halted and unfrozen when game play on the primary game is re-enabled. Any remaining credit of playing time may continue to decrement when game play on the primary game is halted and when play on the primary game is re-enabled. Any remaining credit of playing time may be frozen when the player actuates a cash-out event. The additional wagering opportunities may be triggered and made available to the player more infrequently each time the player declines to avail him or herself of an available additional wagering opportunity. The primary game play may be re-enabled as of a point where the primary game play was halted to offer the additional wagering opportunity. The primary game play may be re-enabled at a different point in the primary game than where the primary game was halted to offer one of the plurality of additional wagering opportunities. One or more of the additional wagering opportunities may be structured based upon player data associated with a loyalty card of the player. One or more of the additional wagering opportunities may be structured based upon at least one of a past performance and behavior of the player.

BRIEF DESCRIPTION OF THE DRAWINGS

FIG. 7 is a flow diagram detailing a cashless time game session in accordance with an embodiment of the present invention.

DETAILED DESCRIPTION

Reference will now be made in detail to the construction and operation of preferred implementations of the present invention illustrated in the accompanying drawings. The following description of the preferred implementations of the present invention is only exemplary of the invention. The present invention is not limited to these implementations, but may be realized by other implementations.

Figure 1:
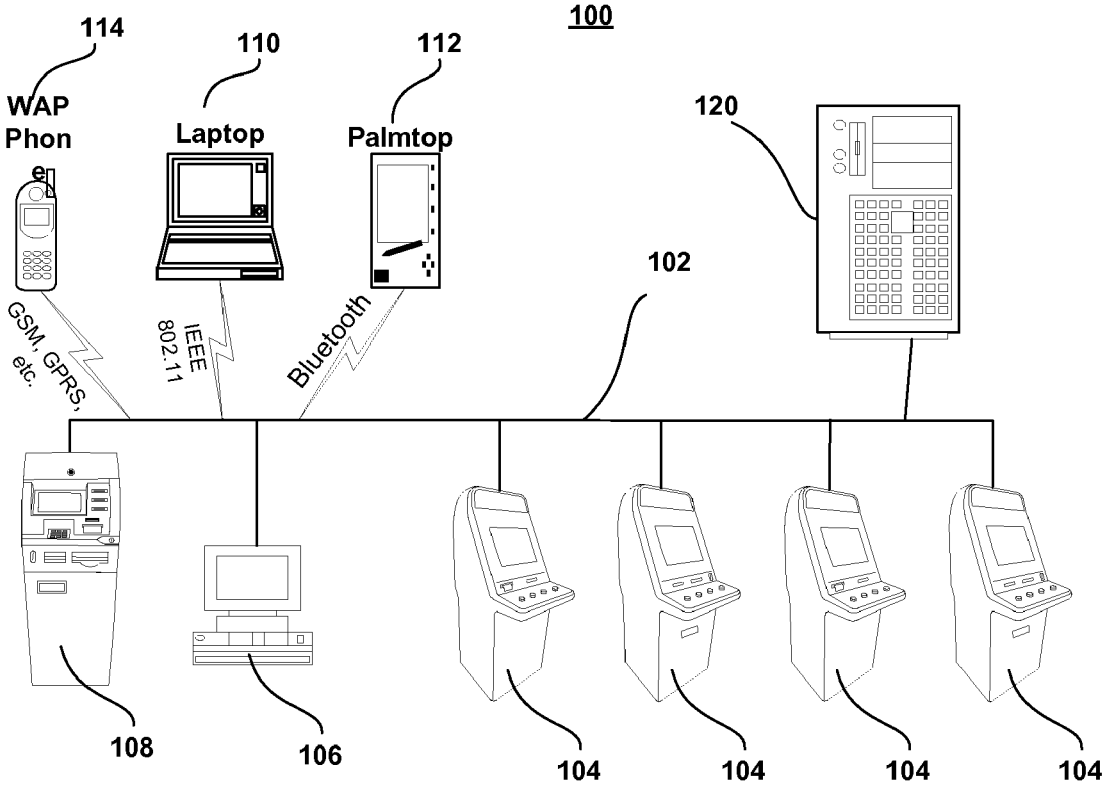
FIG. 1 is an overview diagram of an exemplary cashless gaming system, in accordance with an embodiment of the present invention.

FIG. 1 illustrates a gaming system 100 according to an embodiment of the present invention. The gaming system 100 may include a plurality of gaming terminals 104, a cashier terminal 106 or an automatic cashier 108, a central system 120, all communicating via a wired or wireless network 102. Wireless entry devices such as laptops 110 using 802.11, palmtops 112 using Bluetooth or 802.11, or WAP phones may advantageously be used in some premises for operators to consult and credit the game session meters.

The gaming terminals may be of the traditional cash-in type comprising coins and/or notes acceptors and coins and/or notes dispensers, or alternatively, may be of the cashless type.

Figure 2:
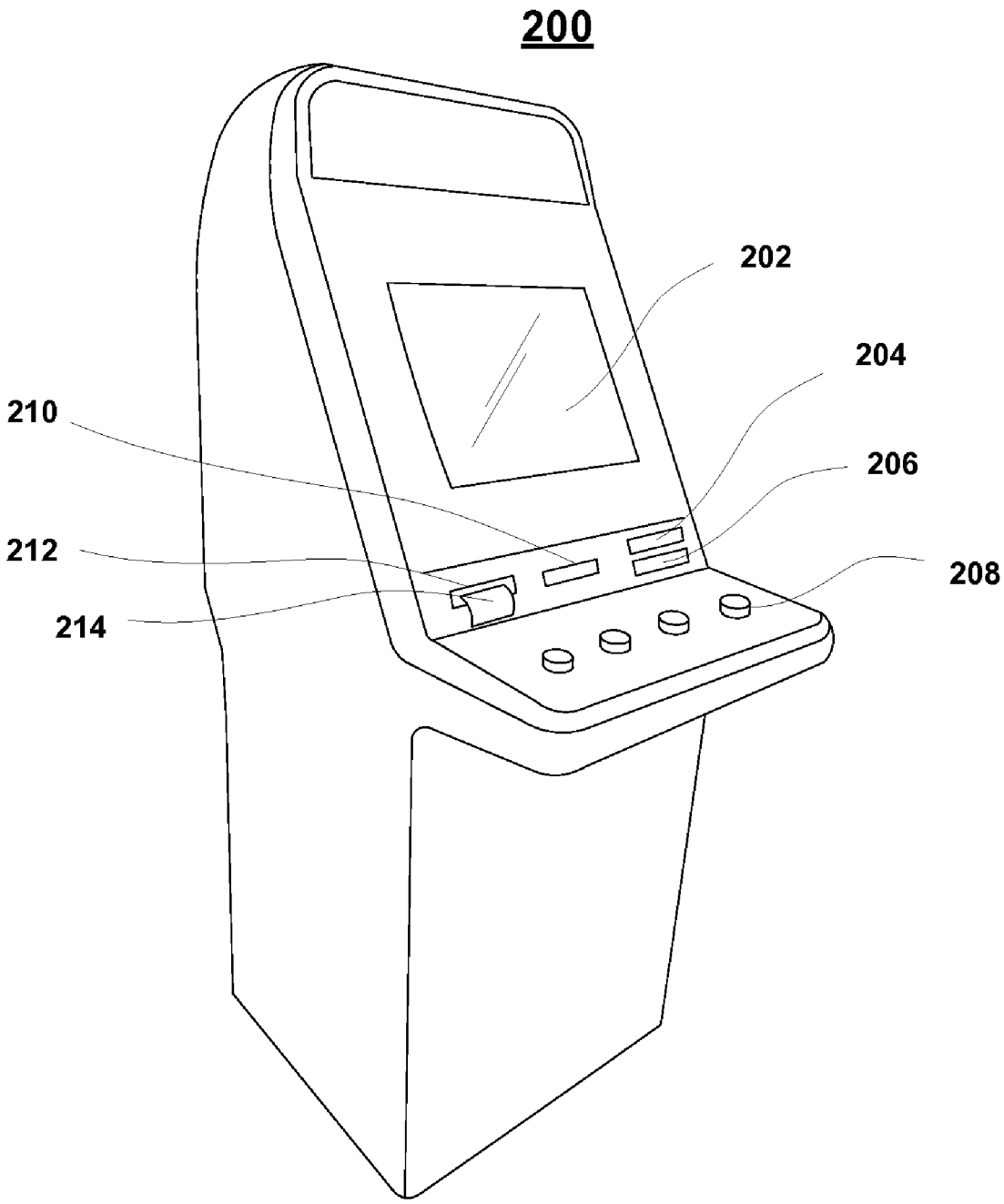
FIG. 2 is a view depicting an exemplary cashless game terminal in accordance with an embodiment of the present invention.

FIG. 2 illustrates an exemplary cashless gaming machine 200 that does not accept or redeem cash. It is to be understood that the gaming machine 200 is but one possible implementation of such a cashless gaming machine and that the present invention is not limited thereto. For cashless operation, the gaming terminal is equipped with means of capturing the encoded information associated with a cashless instrument submitted. The cashless instrument may be a physical portable instrument such as: a paper voucher comprising printed codes; a strong paper ticket comprising printed codes and encoded magnetic codes; a rigid ID card comprising printed codes, magnetic codes or optical codes; a secure contact or contact-less electronic ID device comprising sophisticated electronic (a smart card or a smart USB dongle); or alternatively, a user ID and password to be typed or spoken, or alternatively again advanced biometric features (finger print, voice recognition, face recognition). The information captured from a cashless instrument is processed in order to derive a pointer to a location containing the necessary computer data to identify and validate the cashless instrument. The information captured from a cashless instrument may contain an encrypted signature (or hash) to ensure that the information has not been maliciously modified. The cashless instrument allows to derive a valid "identifier code" that is used by the software to execute the appropriate transactions to emulate the use of real cash for the cashless instrument submitted. The cashless instrument is thus denoted "ID instrument" hereafter. The ID instrument may be capable of storing additional information when accessed by a device, or alternatively be replaced by a new one (i.e. a newly printed ticket). The gaming machine ID device(s) accepting the ID instrument submitted may include a magnetic card reader 204, a SmartCard reader and writer 206, a barcode reader 210, a ticket printer 212, a biometric reader (finger print, voice identification, head identification, etc.), a touch-screen 202, keyboard or keypad to enable players to enter a PIN (Personal Identification Number). The gaming machine identification device(s) may further include an ID token reader to read other forms of advanced ID devices such as ID buttons, USB ID dongles, ID key-chains (such as disclosed, for example in commonly assigned Design Pat. No. D441,765, issued May 8, 2001, entitled "Personal Communicator and Secure ID Device") as well as secure communication means for securely communicating with, for example, personal wallets, hand held PCs or computer wrist-watch via infra red, magnetic field, capacitive charges or RF (Bluetooth, IEEE 802.11, etc.) for player identification purposes. A printer 212 may print bar-coded tickets 214 that can be read by a barcode reader 210.

Figure 3:
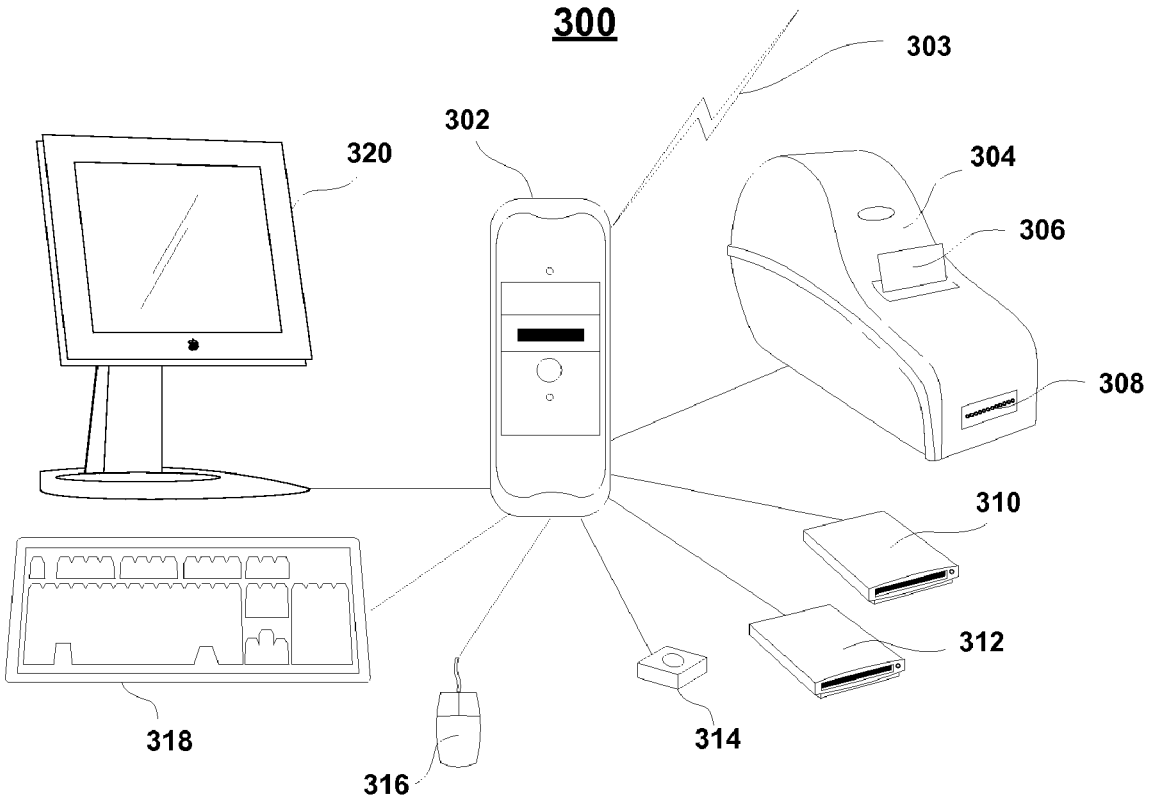
FIG. 3 is a view depicting an exemplary cashier terminal in accordance with an embodiment of the present invention.

FIG. 3 illustrates a cashier terminal 300, according to an embodiment of the present invention. The terminal may include a computer 302 connected via wired or wireless link 303 to the network 102 and to a ticket printer 304. The ticket printer 304 may include an integrated printer for printing tickets or receipts 306 that include a human and/or machine readable code imprinted thereon and code reader 308 for reading the code(s) imprinted on the ticket 306. The cashier terminal may also include, for example, a magnetic card reader 310, a SmartCard reader 312, a biometric reader 314 (such as a fingerprint reader, for example), a display 320 and input devices such as a keyboard 318 and/or a mouse 316. The cashier terminal is controlled by an operating system capable of secure network communication such as Microsoft Windows, embedded XP or Linux, for example.

Figure 4:
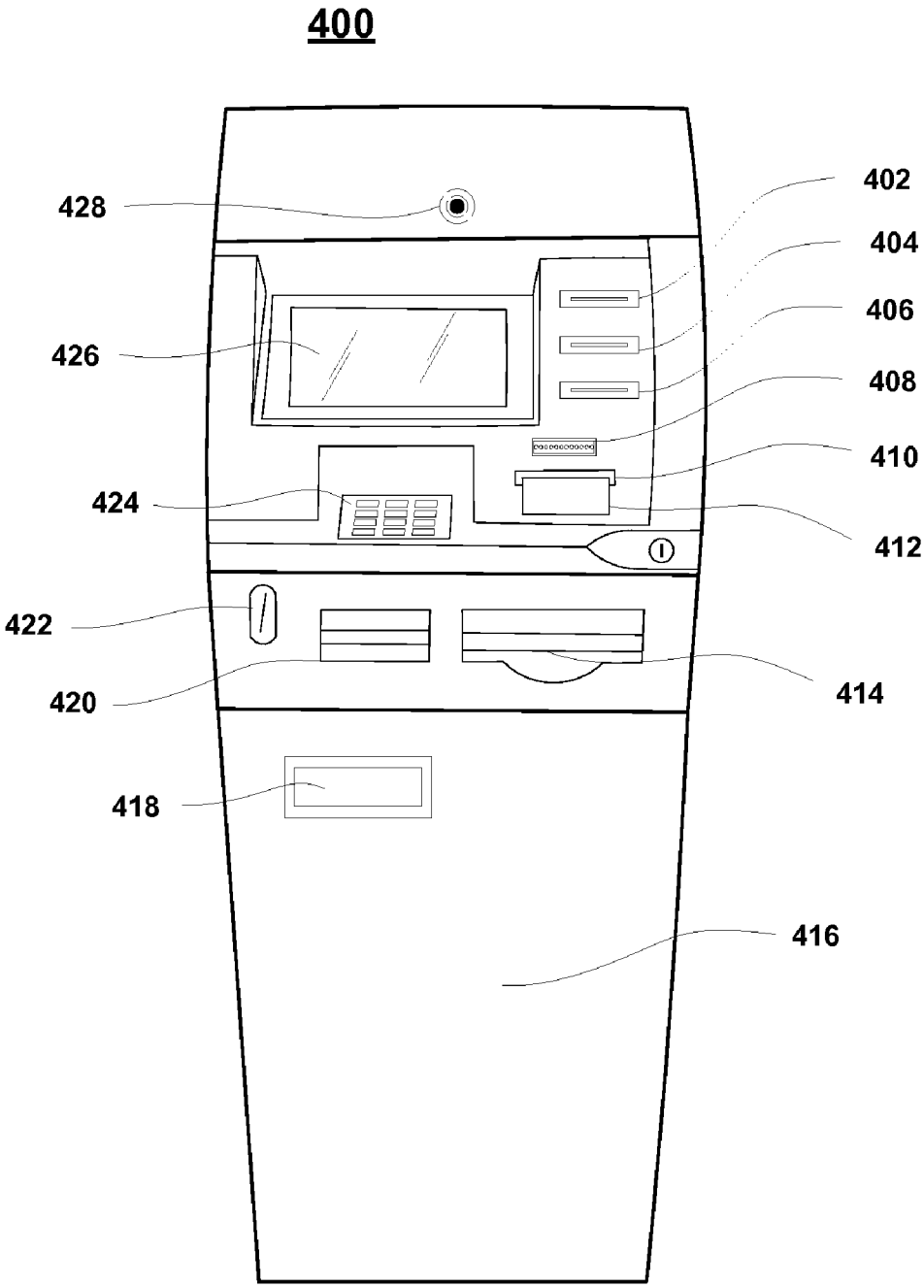
FIG. 4 is a view depicting an exemplary automated cashier in accordance with an embodiment of the present invention.

FIG. 4 illustrates an embodiment of an automated cashier 400, which dispenses with the need for a human cashier. The automated cashier 400 may include an internal computer connected to the network 102 with the gaming terminals 104, a coin acceptor 422, a note acceptor 420, a coin dispenser/hopper 418, a SmartCard or magnetic card dispenser 404, a note dispenser 414, a ticket printer 410 for printing a ticket 412, a magnetic card reader 402, a SmartCard reader/writer 406, a barcode reader 408, display with touch-screen 426, a keypad 424, a video camera 428 and/or a UL 291 certified cash safe 416, for example. The UL 291 certified cash safe 416 prevents robbery of the cash stored inside the automated cashier 400. The automated cashier 400 may further include biometric ID readers, ID token readers to read other forms of advanced ID devices such as ID buttons, USB ID dongle, ID key-chains, etc., as well as secure communications means for communicating with personal wallets, hand held PCs or computer wrist-watch via infra red, magnetic field, capacitive charges or RF (Bluetooth, IEEE 802.11, etc.) for identification purposes.

Figure 5:
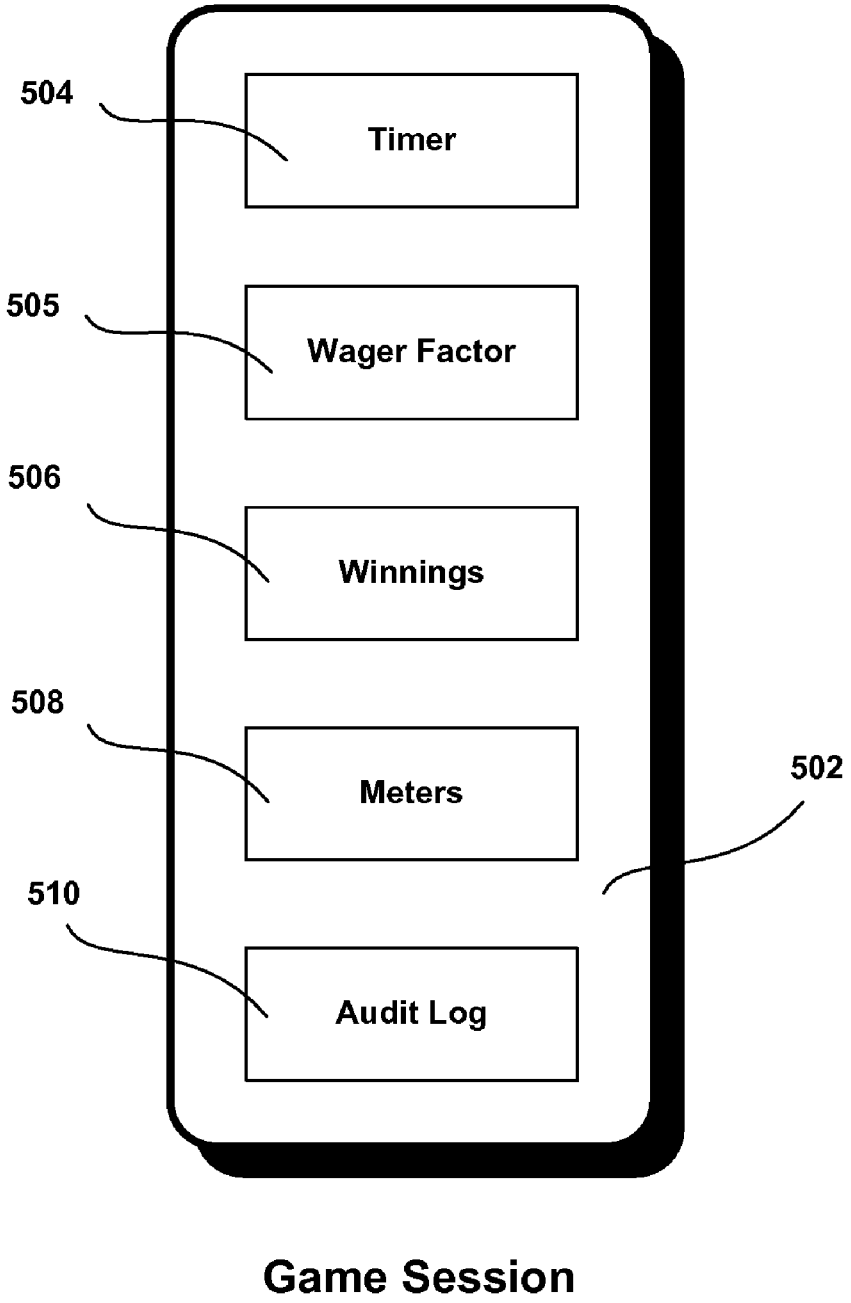
FIG. 5 is a diagram depicting the game session meters in accordance with an embodiment of the present invention.

In compliance with gaming jurisdictions, gaming terminals contain a set of highly secure persistent meters. FIG. 5 illustrates an embodiment of the meters 502 that control a gaming session comprising essentially the patron's game session timer 504, the wager factor 505, the patron's winnings 506, the meters 508 associated with a variety of events such as coins inserted and coins given out for a particular game, and an audit log 510 of events for later examination if required. The wager factor reflects the wager that is applied per unit of time; for example if the patron pays $100 for 2 hours of playtime, the wager factor is 100/2=$50 per hour or 100/(2*3600)=$0.0139 per second. Meters 508 and the audit log 510 are usually reserved for verification purposes by the game operator.

A preferred embodiment makes use of a down-counting timer that is exhausted (time-out) when reaching zero, but the same results may be achieved by making use of up-counting timers that are exhausted (time-out) upon reaching a predetermined value.

Figure 6:
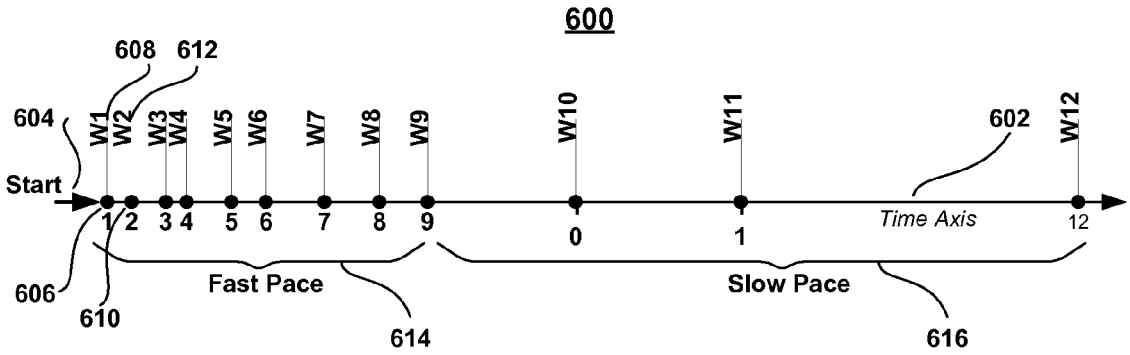
FIG. 6 is a diagram depicting the variable rate gaming during a game session in accordance with an embodiment of the present invention.

Upon initialization of a new game session, the timer is set to the playtime purchased by the patron and the winnings are set to zero. As soon as the patron starts playing, the timer is decremented with a predetermined clock tic, 1/100th of a second for example, and the game session ends when the timer reaches zero. As illustrated in FIG. 6, the patron may play at a variable pace. In the preferred invention embodiment, the wager applied at each game played is variable and is dependent on the pace at which the patron plays. The wager taken into account for calculating the winning outcome at each play is related to the time elapsed since the previous play, also called intermission hereafter. The faster the pace 614, the lower are the wagers considered for calculating the winnings outcome in case of a win. Conversely, the slower the pace 616, the higher are the wagers considered for calculating the winning outcome in case of a win.

As shown in FIG. 6, a game session 600 may start 604 when for example the patron triggers the play button for the first time 606. The wager W1 608 associated with the first play 606 may be a predetermined amount, $0.10 for example. Subsequent play triggers are plotted on the time axis 602. The wager W2 612 associated with the second play 610 that occurs 2.76 seconds after first the play 606 may be $0.23; wager W3 for third play that occurred 3.84 seconds after the second play 610 may be $0.32. Table 1 hereunder shows the wagers applied for each of the games played of FIG. 6, and until the session ends after 2 hours of playtime purchased for $100.

TABLE 1

| Play # | Intermission (sec) | Wager (in $) |
|---|---|---|
| 1 | — | 0.10 |
| 2 | 2.76 | 0.23 |
| 3 | 3.84 | 0.32 |
| 4 | 1.68 | 0.14 |
| 5 | 3.84 | 0.32 |
| 6 | 4.08 | 0.34 |
| 7 | 5.04 | 0.42 |
| 8 | 5.64 | 0.47 |
| 9 | 5.16 | 0.43 |
| 10 | 14.52 | 1.21 |
| 11 | 16.44 | 1.37 |
| 12 | 32.52 | 2.71 |
| . . . | . . . | . . . |
| Last | 5.04 | 0.42 |
| TOTAL | 2 Hours | 100.00 |

In a preferred embodiment, in case of a win, the interval of time between the last play and the previous play (the intermission) is taken into account as a multiplier when the winnings are credited. For example, for the same matching symbols, if the intermission is 5 seconds the winning amount credited is $100; if the intermission is 15 seconds the winning amount credited is $300.

FIG. 7 illustrates a cashless time game session in accordance with an embodiment of the present invention. The player goes to a cashier 702 and remits 704 for example $100 to play for 2 hours. Using a terminal 300, the cashier sets some parameters associated with an ID instrument 706 that he remits to the patron 708. The parameters are essentially: Instrument ID=X1Y2Z3, Timer=2 hours or 120*60=7200.00 seconds, amount=$100. The parameters are accessible by any gaming terminal on which the patron may play.

The patron then selects a gaming terminal at 710 and submits its ID instrument at 714. As shown at 716, the gaming terminal binds to a timer that is initialized with the parameters associated with the ID instrument. The timer may be located on the local gaming terminal or on a computer system accessible via the network. In this example, the timer is set to the value 720,000 assuming a tic timer of 1/100th of a second and the wager factor is set to 100/720000=$0.000139 per 1/100th of a second of intermission. Each time the patron triggers a new game 718, the intermission is captured, as shown at 720. In a preferred embodiment of this invention, the wager taken into account for the computation of the outcome in case of a winning at the first game 722. If this is the player's first game (YES branch 724), the wager is a predetermined amount 726, as shown at 726. If this is not the player's first game (NO branch 728), the wager taken into account for the computation of the outcome in case of a winning is a function of the intermission, as shown at 730. The game is executed at 732 and in case of a win, the prize money is credited to a winning account associated with the ID instrument. After a game completion, the game session is ended as shown at 738, if the timer 734 has timed-out as indicated at 736. If the timer has not timed-out (NO branch 740) and the patron wishes to continue to play (does not wish to cash out), the patron may continue to play, as indicated by the NO branch 744. If the patron, however, activates the cash-out signal 742, the method proceeds to 746, whereupon the timer is frozen at 747. The player may select another gaming machine 710 to play or, as shown at 748, may go to the cashier to redeem his winnings and unused time 750.

In a preferred embodiment, the wager variation together with the associated changing prize return while the time elapsed since last game increases, may be dynamically displayed to the patron.

In another preferred embodiment of the present invention, an automated cashier 400 is used by the patron instead of going to a cashier.

In yet another preferred embodiment of the present invention, the gaming terminals are equipped with coins and/or note acceptors and an amount of time to play is purchased directly on the gaming terminal by inserting the corresponding money amount. Any prize money won is paid-out immediately by the coin/note dispenser without interrupting the time game session. Alternatively, prize money is credited without interrupting the time game until timer times-out or the cash-out signal is activated.

In yet another preferred embodiment of the present invention, the patron may use prepaid card such as smart cards or magnetic card with a secret number to be revealed when scratching. The patron may also use prepaid vouchers comprising machine readable printed codes and optionally verification numbers to be keyed-in.

The time gaming method object of the present invention is suitable for supporting all forms of cashless instruments such as:

a player account;

an anonymous game session account;

a voucher verification account;

a smartcard reconciliation account.

A cashless player account is identified by a unique identifier key assigned to a patron that points to a set of records stored in computer memory containing the patron's personal details and the state of the cashless session. The records may be queried and updated by authorized software using the key, which may be derived from the ID instrument submitted. The state of the cashless session comprises essentially the balance of time-to-play and the total of winnings available to the patron and some auxiliary attributes reflecting the games played, the time stamping of various operations and a flag indicating if available credits have already been paid.

An anonymous game session account is identified by a unique identifier key assigned to a game session that points to a set of records stored in computer memory containing the state of the cashless session. The records may be queried and updated by authorized software using the key that may be derived from the ID instrument submitted. The state of the cashless session comprises essentially the balance of time-to-plat and the total of winnings available to the anonymous older of the ID instrument and some auxiliary attributes reflecting the games played, the time stamping of various operations and a flag indicating if available credits have already been paid.

A voucher verification account is identified by a unique identifier key assigned to a voucher that points to a set of records stored in computer memory containing the state of the cashless session. The records may be queried and updated by authorized software using the key, which may be derived from the voucher submitted. The state of the cashless session comprises essentially the balance of time-to-play and the total of winnings available to the holder of the voucher and verification data, and some auxiliary attributes reflecting the games played, the time stamping of various operations and a flag indicating if available credits have already been paid. In the case of a cash-out at the gaming terminal or alternatively when funds are remitted to a human cashier or an automated cashier, a voucher comprising clear text and machine-readable code representing the monetary value of the credit available and some verification data is dispensed. The clear text may indicate the value of the credit of time-to-play available, or simply said for the holder, "the value of voucher." In the case of a cash-in at the gaming terminal or alternatively when requesting the redeem of the winnings to a human cashier or an automated cashier, a voucher comprising clear text and machine-readable code representing the monetary value of the winnings available and some verification data is read. The unique identifier key is derived from the verification data upon reading the clear text and/or the machine-readable code. The associated records are then queried in order to authenticate the value of the voucher by comparing the verification data contained in the records with the verification data read from the voucher. It should be apparent to those acquainted with secure transactional techniques that the unique identifier key, or alternatively the verification data, may be a hash or an encrypted signature of all or portion of the clear text and/or the machine-readable code.

A smartcard reconciliation account is identified by a unique identifier key assigned to a smartcard that points to a set of records stored in computer memory. The records therefore are a "slave" mirrored copy of same records containing the state of the cashless session that are maintained in the electronic circuits of the smartcard. The smartcard maintains the "master" copy of the records. The slaved mirrored records may be queried but not updated by authorized software using the key that may be derived from the smartcard submitted. The state of the cashless session comprises essentially the balance of time-to-play and total of winnings available to the holder of the smartcard and some auxiliary attributes reflecting the games played, the time stamping of various operations and a flag indicating if available credits have already been paid. The slaved mirrored records are used to reconcile accounting when the smartcard is used in order to detect possible forgery. Alternatively, the slaved mirrored records are used as a backup repository to pay the holder of the smartcard in case of the failure of the smartcard. When used for backup, the "slave" records may be updated by authorized software using the key that may be derived from the smartcard submitted (embossed code for example).

The ID instrument used to derive the unique identifier key may be submitted in a variety of ways such as typing a user ID and password, keying-in a code on a keypad, presenting a bar-coded voucher, an encoded card, a secure electronic ID device or recognizing biometric features.

The unique identifier keys are commonly called GUI or global unique identifier.

Figure 8:
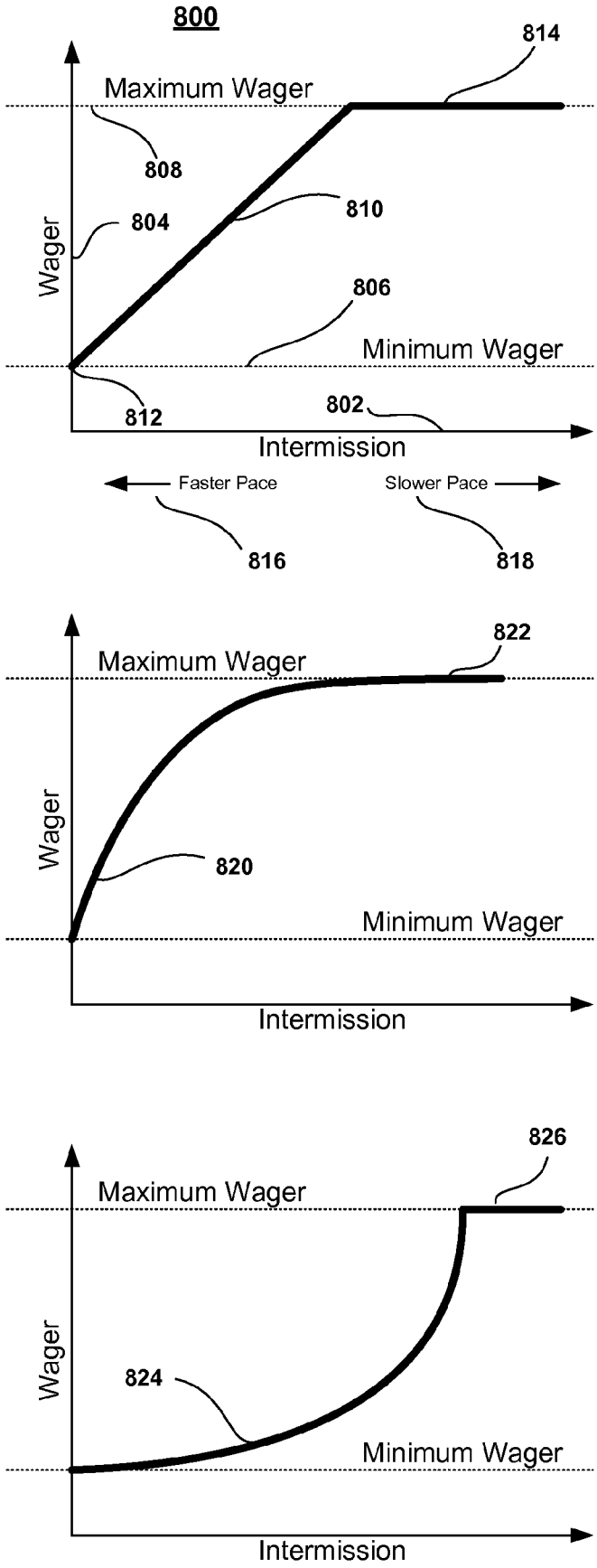
FIG. 8 is a diagram depicting various applicable time-function wager profiles in accordance with an embodiment of the present invention.

Various profiles 800 may be available for implementing the wager function, as shown in FIG. 8. For example, a linear function 810 may be chosen between a minimum wager 806 and a maximum wager 808, with a minimum wager amount 812 for the shortest intermission, and a maximum wager amount 814 when intermission exceeds a predetermined amount. Alternatively, an aggressive sensitivity to intermission acceleration 820 may be chosen which rapidly reaches the highest wager amounts 822 for the shortest intermissions. Alternatively yet, a soft sensitivity to intermission acceleration 824 may be chosen which reaches the highest wager amounts towards the largest intermissions.

In a preferred embodiment of the present invention, a prize matrix such as the exemplary matrix shown in Table 2 may be simply constructed in which the prize money is proportional to the intermission.

TABLE 2

Prize matrix

| | Winnings US$ for X seconds Intermission | | | | | |
|---|---|---|---|---|---|---|
| Draw | 1 (reference) | 2 | 5 | 10 | 20 | 50 |
| 4 aces | 1,000 | 2,000 | 5,000 | 10,000 | 20,000 | 50,000 |
| 3 aces | 100 | 200 | 500 | 1,000 | 2,000 | 5,000 |
| 4 identical symbols | 200 | 400 | 1,000 | 2,000 | 4,000 | 10,000 |
| 3 identical symbols | 10 | 20 | 50 | 100 | 200 | 500 |
| . . . | . . . | . . . | | | . . . | . . . |

For other intermission values, the equation may be: Prize=Prize (Reference)*Intermission, wherein Intermission may be expressed in 1/100th of a second, for example.

In the exemplary table 2 above, the prize reference is set for 1 second. Consequently, in case of a win with 3 aces and an intermission of 2.73 seconds, the prize money is $100*2.73=273.00.

In a preferred embodiment of the present invention, a facility may be provided to enable the player to play games in a synchronized fashion in which games are automatically triggered by some form of psychedelic or ambiance input such as music tempo, microphone input tempo and video tempo. The games are automatically triggered following a manual arming activated by the player.

Figure 9:
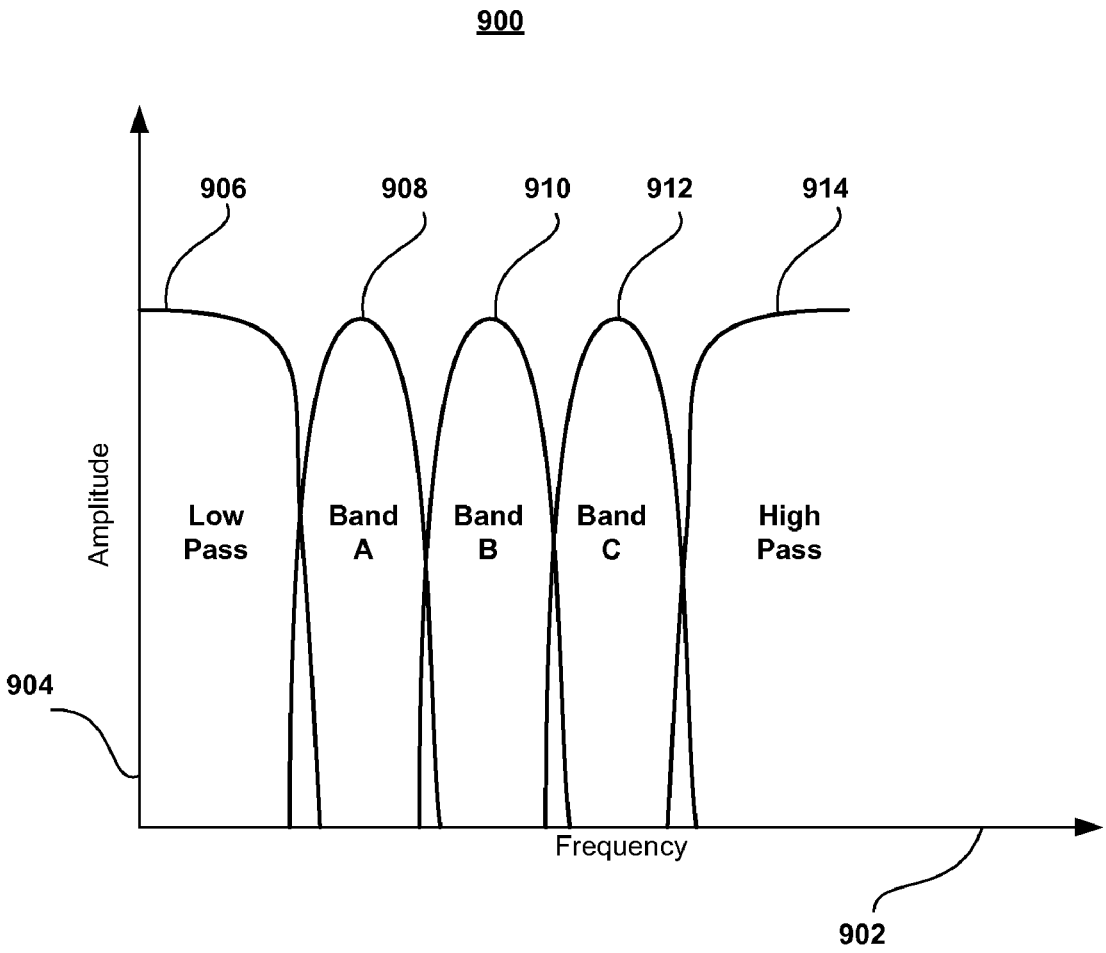
FIG. 9 is a diagram depicting audio frequency filters in accordance with an embodiment of the present invention.

FIG. 9 illustrates a typical set of sound frequency filters plotted on a frequency axis 902 versus an amplitude axis 904 for driving the psychedelic lights commonly found in disco-dancing places whereby multicolored spotlights are modulated by the music played. Spotlights of a given color are associated with a given filter band to achieve a desired illumination rhythm. For example, purple colored spotlights may be associated with the low pass filter 906, green colored spotlights may be associated with the high pass filter 914, yellow colored spotlights may be associated with the A pass-band filter 908, blue colored spotlights may be associated with the B pass-band filter 910 and red colored spotlights may be associated with the C pass-band filter 912.

Frequency filters may be implemented using analog electronic circuits and digital electronic circuits. Alternatively, the signal to filter may be digitized then mathematic functions may be applied in software in order to obtain the desired filtering to modulate or trigger a given device such as a spotlight, an alarm, and an event.

The output of a selected filter applied to music, speech, surrounding sound, surrounding light, or video images may be used as an external triggering event to start a game. An adjustable level threshold control button may be used for triggering for example. A manual arming by the player may be advantageously provided prior to the triggering by an external event.

Figure 10:
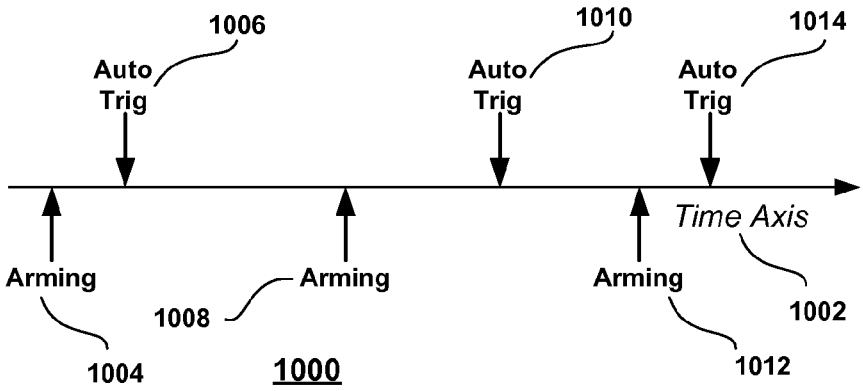
FIG. 10 is a diagram that depicts manual arming by the patron followed by one auto trigger in accordance with an embodiment of the present invention.

FIG. 10 illustrates on a time axis 1002 the manual arming 1004 activated by the player. An auto triggering 1006 signal driven by the filtered external event may occur at any time subsequent to arming. The triggering signal starts the game. For another game to be played, the player may arm again 1008, and then an auto trigger occurs moments later. This scenario may be repeated continuously whereby an auto trigger occurs moments later after a manual arming by the player and whereby the triggering is driven by an external event, until the credit of time is exhausted or the cash-out event is activated. In scenario 1000, only one trigger can occur after each arming. The intermission to compute the wager amount is the time elapsed between triggering events.

Figure 11:
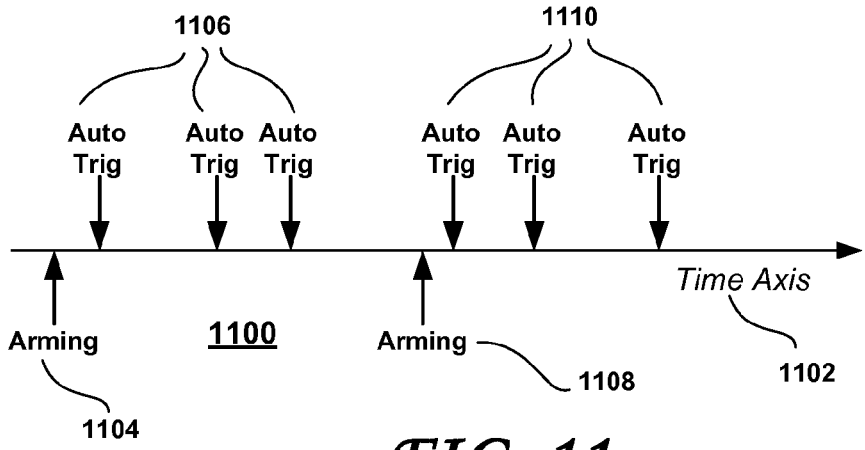
FIG. 11 is a diagram that depicts manual arming by the patron followed by three auto triggers in accordance with an embodiment of the present invention.

FIG. 11 illustrates another scenario wherein three (3) automatic triggers 1106, 1110 may occur after each manual arming 1104 and 1108 respectively initiated by the player. The choice for the number of triggers occurring automatically after an arming as well as the external triggering source may be selectable by the player. The intermission to compute the wager amount is the time elapsed between triggering events; the instant when the arming occurs is ignored.

Figure 12:
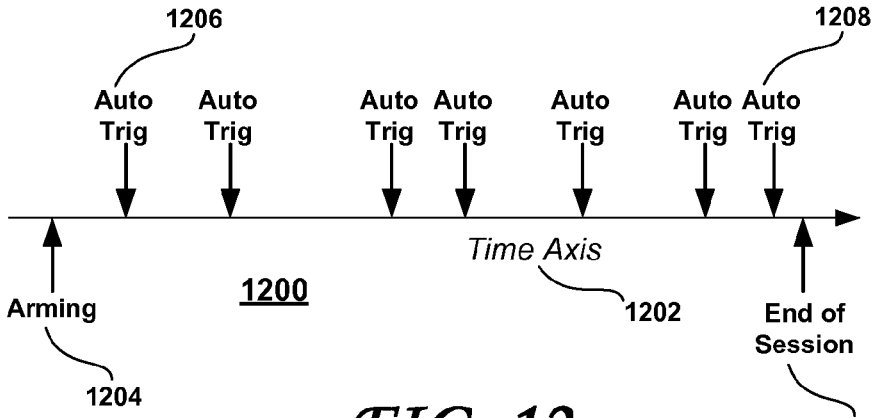
FIG. 12 is a diagram that depicts manual arming by the patron followed by continuous auto triggers in accordance with an embodiment of the present invention.

FIG. 12 illustrates a scenario wherein continuous automatic triggers 1206 to 1208 may occur after an initial manual arming 1204 performed by the player. The triggers occur automatically and continuously driven by the external triggering source selected by the player. The parameters of the triggering source may be varied by the player in order to obtain a desired triggering tempo. The intermission to compute the wager amount is the time elapsed between triggering events.

Further embodiments of the present invention include adaptations of games of skill played on domestic gaming consoles to casino games of chance giving the impression to the player that his skills may affect the outcome, thus "virtual skill game" term will be used hereafter. Although not currently allowed in all gaming jurisdictions in the United States, auto-triggering or auto-bet is described hereafter in a preferred embodiment of the invention in anticipation that in the context of time gaming, auto-bet will be allowed. Indeed, according to an embodiment of the present invention, a player may pay a certain sum of money to play a gaming machine for a predetermined period of time. That is, a player may activate a game session on a gaming machine with a credit of playing time, the game session enabling the player to play the game(s) offered on the gaming machine for an amount of time determined by the credit of playing time. The game of skill may involve a narrative, a quest, or a predetermined goal (such as winning a race or vanquishing an enemy, for example). Examples of such games are disclosed, for example, in co-pending and commonly assigned U.S. provisional patent application Ser. No. 60/738,812 entitled "Multi-Act Style Electronic Game", which application is hereby incorporated by reference in its entirety. Skill, within the context of the present invention, encompasses feats of manual dexterity, as well as problem solving and other manifestations of intellectual prowess. The term skill, within the context of the present invention may also be extended to encompass how well a player cooperates with others in solving a common task, in a multi-player game. Other embodiments of the present invention are compatible with and may be adapted to function with commercially available gaming console-type games, such as the games available for the game consoles from Microsoft, Sony and Nintendo or Electronic Arts, for example. Specific examples include, for example, first person games based upon the popular Super Mario character, the Need For Speed series of games, Packman and others. Other embodiments of the present invention may be natively-developed games that find no counterpart in the games available for game consoles.

According to embodiments of the present invention, such games may be modified to support wagering within the context of, for example, a gaming session of limited duration, as determined by the player's credit of playing time. For example, in the case of Super Mario, the title character may pursue his eternal quest and evade capture, avoid being blown up, being eaten and suffering like perils and indignities. Instead of collecting coins, points, health or lives, as is the usual case with such console games, each or selected challenges faced by the character may define a new wagering opportunity. The amount of the wager may be a fixed amount determined by the game, may be a fixed amount chosen by the player and/or the amount of the wager may be dependent upon the time period that has elapsed since the player's last wager. That is, the wager may be a flat amount (e.g., $5) as selected by the gaming machine or as chosen by the player, or may be, for example, a base amount multiplied by the above-described wager factor (which reflects the wager that is applied per unit of time and which may grow or otherwise change as the time between successive wagers increases) or otherwise affected by the intermission. In the case of flat amount wager (e.g., $5), the funds may be debited from a separate credit account (not the time credit account) that is credited with cash, cashless tickets, bonuses or winnings from a time game. As betting opportunities are triggered by the player's skills at having (e.g.) the Super Mario character kick goodies and evade annihilation. The outcome of these triggered betting opportunities is then subsequently randomly drawn, although the player may have the impression that his skills affect the outcome. In this manner, the player's skill may be perceived as being instrumental in the outcome of the game. Indeed, a more skillful player that tends to be more successful in navigating through the game's different levels and in avoiding the pitfalls that may plague comparatively less skilled players may perceive that his or her chances of winning are rather high. Contrast with, for example, betting games such as one arm bandit fruit games, in which it is generally perceived that skill plays no factor whatsoever in the determination of the outcome. However, for each or selected ones of the game features (bombs, assorted perils) for which console gamers would conventionally accumulate (or subtract) points, games according to embodiments of the present invention enable a wager to be placed. The outcome of the wager (as opposed to the outcome of the game, e.g., winning the race, rescuing a Princess from a castle, reaching a higher game level) is random. That is, the outcome of the wager is determined by one or more random number generators, as is known in the gaming industry. In this manner, games and game machines according to embodiments of the present invention enable casinos and other gaming establishments to leverage the enormous goodwill and accumulated store of skill represented in players of consumer game consoles into exciting betting games (with which the players may already be familiar and proficient in the non-betting variant thereof) and additional revenue streams.

Figure 13:
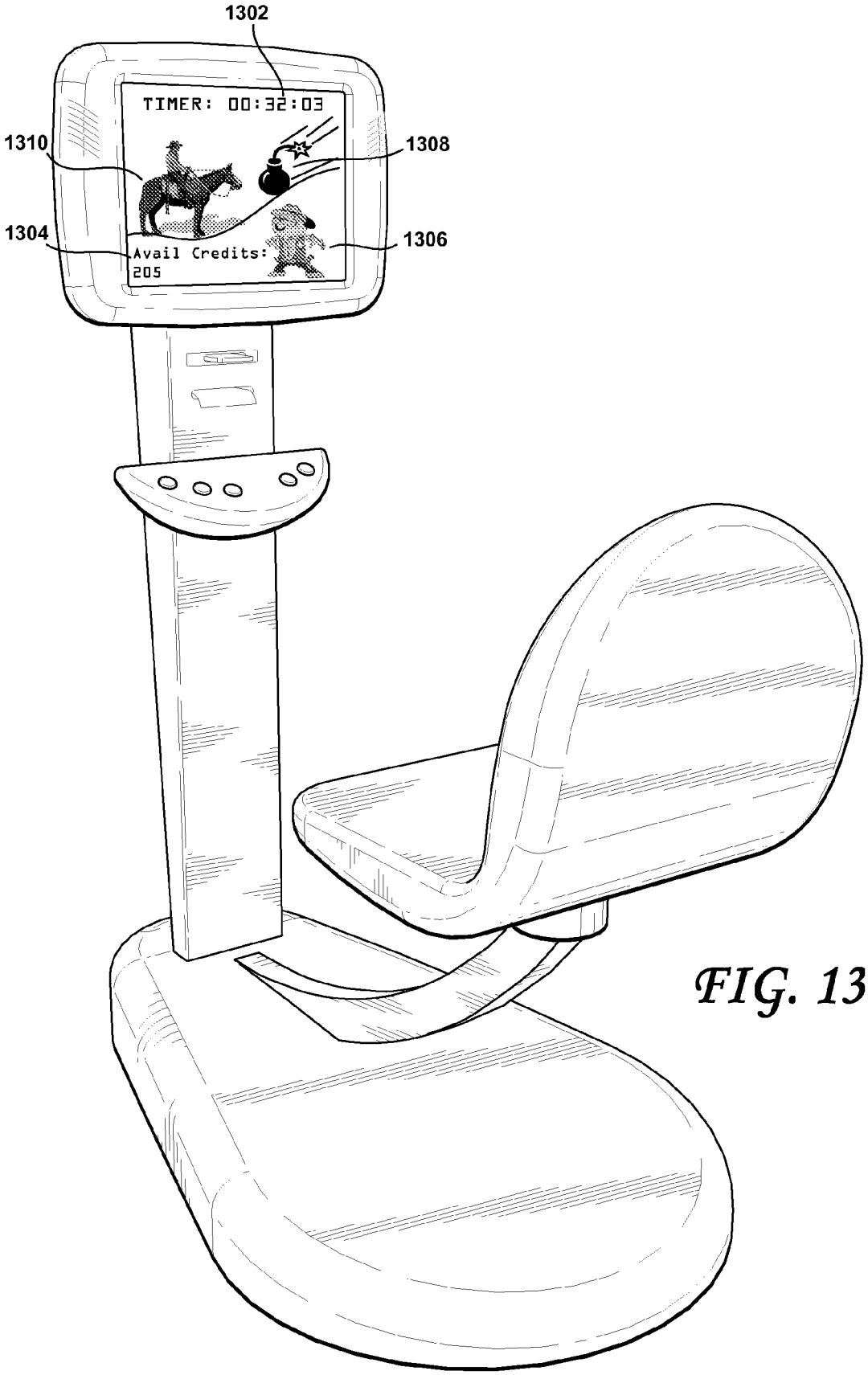
FIG. 13 shows an example of a game of skill that offers wagering opportunities, according to an embodiment of the present invention.
Figure 14:
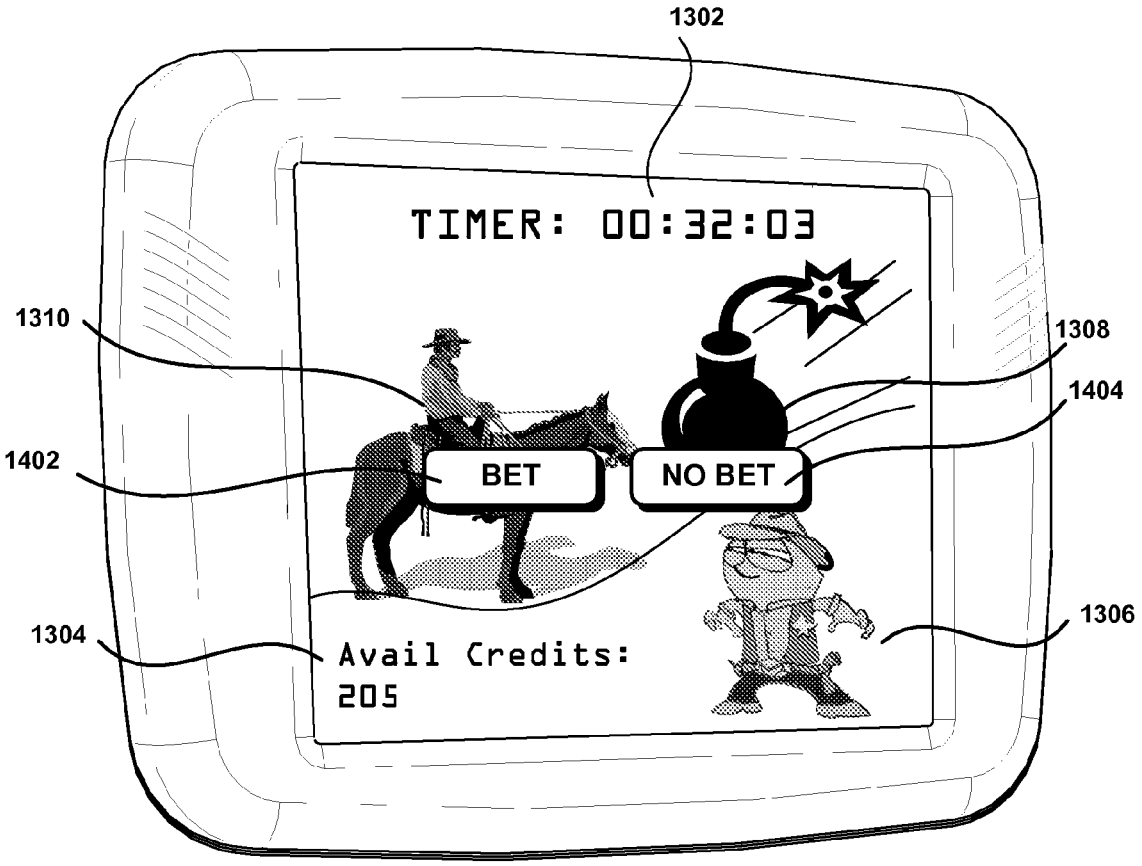
FIG. 14 shows the game of skill of FIG. 13 and the "Bet" or "No Bet" buttons that require the player to positively confirm his or her intention to bet on the offered wagering opportunity, according to another embodiment of the present invention.

For example, as shown in FIGS. 13 and 14, an embodiment of a game according to the present invention is a console-type game in which a character 1306 controlled by the gaming machine player must navigate through a varied terrain while encountering perils and challenges which he must overcome. One such peril is shown in FIG. 13, in which a bomb 1308 is rolling down a hill, potentially endangering the character 1306 and/or the cowboy 1310. At this point in this exemplary game, the gaming machine player may have a choice of one or more strategies or tools to defuse the bomb and/or cause it to explode harmlessly. The player may choose to employ one of these strategies and/or tools to overcome the threat posed by the rolling bomb 1308. The outcome of employing such strategies and/or tools does not depend upon the skill of the player wielding them but the player may believe that it does. At this point in the game, whereas a conventional console-type game would award (if player was successful) or take away points, health or lives (if the player was not successful), a gaming machine and game according to embodiments of the present invention may either automatically wager a predetermined amount (chosen by the player or the gaming machine, depending upon the implementation and what is allowed in the relevant gaming jurisdiction, and the credit available which is separated from the credit of playing time) on the outcome of the player's attempt to defuse the bomb 1308. According to embodiments of the present invention, the gaming machine (or a server coupled to the gaming machine) may then determine the outcome of the wager randomly, based upon the output of one or more random number generators. The gaming machine would then award a specific amount of money or credits, depending upon predetermined odds for the peril the player attempted to overcome. According to embodiments of the present invention, the amount wagered may be dependent upon the elapsed time since the last time that the player placed a wager during his or her gaming session, in the manner described relative to, for example, FIGS. 6-12. As shown in FIG. 13, the player's current credits or balance may be shown (periodically or all the time), as shown at reference numeral 1304. The remaining time of the player's credit of playing time may also be shown, such as at reference numeral 1302. In the illustrative example of FIG. 13, the player has about thirty two minutes remaining of the gaming session. Unless extended by some mechanism in the game, the player's game session will end at the expiry of his or her remaining credit of prepaid playing time.

The perils and challenges that the player must overcome may be collectively referred to as "winning features." The player may be exposed to countless such winning features during his or her credit of playing time. The game may be a new game or a new type of game with which the player may not initially be familiar. With richly rendered graphics and sound, engaging interactivity and compelling plot, however, the player may rapidly find him or herself invested in the outcome of the game. Other embodiments of the present invention, however, contemplate the modification of existing console and/or arcade-type games such that a plurality of wagering opportunities arises during the course of game play. Such games may already be familiar to many players. When coupled with the wagering features described herein, such games may become even more popular. Indeed, gaming machines may be configured to play console or arcade-type games aimed at a specific demographic, such as, for example, age. Indeed, the functionality of such old standbys as Pac Man®, Missile Command, Mortal Kombat® or the series of games based upon the Star Wars® universe may be increased by adding wagering opportunities to the game play thereof, as described above.

Enabling an AutoBet feature in which the gaming machine automatically places a wager on the winning feature (the wager being dependent upon, for example, the elapsed time since the last time a wager was placed—that is, dependent upon the intermission) may not be allowed in the relevant gaming jurisdiction. In that case, another embodiment of the present invention may include features that may render the game allowable by local gaming authorities. Indeed, as shown in FIG. 14, each time a player encounters a winning feature, buttons 1402, 1404 (or a similar functionality) may appear or may be made active, inviting the player to positively choose whether to Bet 1402 or Not Bet 1404 on the winning feature. Other functionality may be included to enable the player to choose the amount of the bet, in addition to choosing whether to place a bet in the first place. According to one embodiment of the present invention, should the player select the Bet button 1402, the gaming machine may automatically determine the amount to wager depending upon the elapsed time since the last wager placed or may request that the player select a wager. Thereafter, the outcome of the wager is wholly random, with the credits or money awarded (if the player wins) or taken away (if the player looses) being dependent upon predetermined odds for that winning feature and generated random number(s). Accordingly, embodiments of the present invention provide for methods and systems for players to purchase a time credit, play a vibrant console type or arcade-type skill game and place countless numbers of bets until the time credit has elapsed. Other embodiments of the present invention enable a two-player console type skill game that allows two players to enter a fierce challenge and place countless numbers of bets until the time credit has elapsed. Wherever gaming regulation allows time-gaming AutoBet (or auto-trigger), then the bet outcome result (instead of fixed points) may be briefly shown and accumulated each time a winning or losing feature is hit along the play path; otherwise a "Bet" or "No Bet" prompt confirms that a betting opportunity has been offered and requests that the player confirm his or her intention to place the bet. A "No Bet" may be automatically selected if the player does not respond within a predetermined or selectable timeout period. The timeout period may be selected by the player such as to correspond to their favorite gaming style.

It should be noted that, in order to use and/or modify existing console-type or arcade-type games in conjunction with embodiments of the present invention, the proper authorizations and licenses from the owners of the games must be obtained.

Assume now, for example, that the game is a racing game of chance in which the player has paid $100 for two hours of game play. Suitable racing games are disclosed, for example, in co-pending and commonly assigned application Ser. No. 10/389,463, filed Mar. 13, 2003, entitled "Methods and systems for electronic virtual races", which is hereby incorporated herein by reference in its entirety. The player's wagers may be, as detailed above, dependent upon the time elapsed since the last wager. For example, the player may be invited to wager as soon as his vehicle passes the finish line and may be invited to wager as soon as his vehicle posts the fastest lap times or, for example, may be invited to place a wager as soon as his vehicle passes another vehicle. The actual event(s) wagered on may be selected by a random number generator (RNG), as is well known. Therefore, the actual outcome of the game is determined randomly, even though the player may be given the impression that his or her skill affects game play or his or her reward.

Other embodiments of the present invention allow for even greater wagering choices. For example, the game play may involve a narrative, or may include individual events that are loosely coupled to one another to form a narrative or a developing story. Even a car racing game may be structured as a narrative, with lap-by-lap commentary, stats and pit stops. According to embodiments of the present invention, the player may be provided with additional wagering opportunities, even during the time-based gaming described above. Continuing with the car racing game example being developed herewith, the timed game may be configured to stop the main gaming action (in effect, "freezing" the action) for the purpose of offering an additional betting opportunity to the player. Such a separate betting opportunity may, according to an embodiment of the present invention, be contextually driven and may be unrelated to the betting opportunities of the car racing game. Indeed, the additional betting opportunity may be derived from what is currently happening in the game (i.e., the current context of the game). For example, in a racing game in which a wide angle shot of the raceway is displayed on the gaming machine's display(s), the player may be given the opportunity to bet whether a sponsor's blimp will float across the sky over the raceway within a predetermined period of time. Alternatively, the player may be given the opportunity to place a wager on which of a predetermined list of products or services will next be advertised on the sides of the blimp, thereby affording additional revenue streams from product placement spots within a regulated game of chance. In any event, the main game play (in this exemplary case, the car race) may be momentarily interrupted, and the player invited to place a wager. According to other embodiments, game play need not be stopped when an additional wagering opportunity is presented to the player. Such an invitation may take the form of, for example, a pop-up window over the display. Such a pop-up window may request that the player make a choice whether to place a wager or to decline to do so. This may take the form of, for example, player-actuable "Bet" and "No Bet" buttons appearing on the screen. This betting opportunity may also appear for a limited period of time, and a down-counting (for example) timer may also be displayed. Failure to choose whether to place the wager or to affirmatively decline to do so may result in the offer to place the wager being rescinded at, for example, the expiration of the timer. In any event, an affirmative action by the player (e.g., the player pressing the "Bet" button before expiry of the down-counting timer) may be required for a wager on the offered additional betting opportunity to be placed.

Assuming the additional wager has been placed, game play may be resumed from the point at which it was previously interrupted. That is, the car race may resume as of the point at which it was interrupted to bring this additional wagering opportunity to the player. Moments later, during the on-going race, the player may view the randomly generated outcome of his or her additional wager. Continuing with the example developed herein, a blimp may cross the sky above the raceway (which would be a win for the player if the player had wagered on the blimp appearing in the sky) or, for example, a formation of supersonic fighter aircraft may streak across the sky above the raceway instead, signaling that the player has lost this particular additional betting opportunity (because the player bet that a blimp would float across the sky, and not fighter aircraft). Alternatively, the blimp may appear and display an advertisement of the product or service. If the displayed advertisement features the wagered product or service, the player wins this particular additional betting opportunity.

Figure 16:
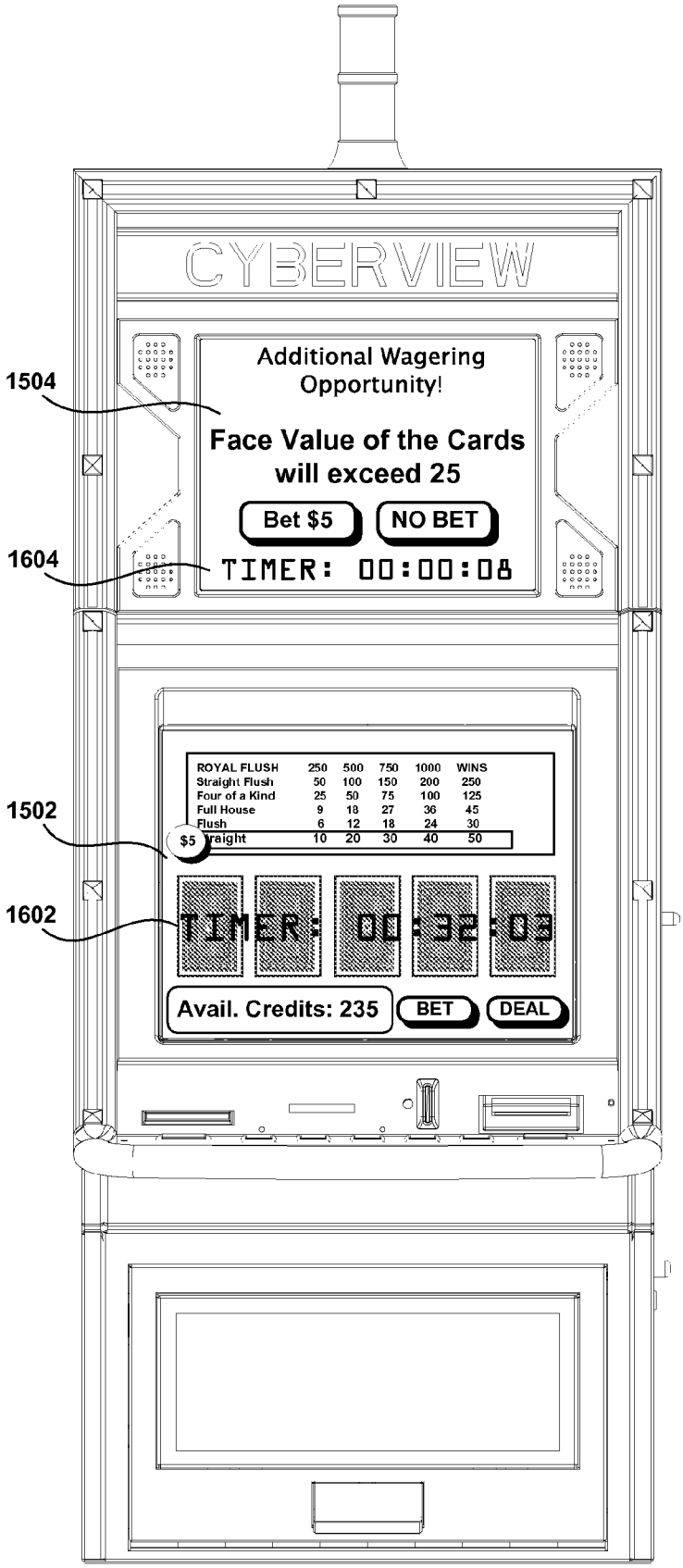
FIG. 16 shows an exemplary contextually-driven additional wagering opportunity, to illustrate further aspects of embodiments of the present invention.

As shown in FIG. 16, according to an embodiment of the present invention, the main timer 1602 (the timer counting down the remaining time of the current cashless time game session) may be stopped when the additional wagering opportunity is displayed or the main timer may continue counting down. If the main timer 1402 is stopped, the time the user spends on the additional wagering opportunity does not count in the computation of the wager factor described above. If the main timer 1402 is not stopped and continues counting down as the player considers whether to avail him or herself of the additional wagering opportunity, the wager factor may continue to increase as set forth above, thereby affecting the amount of any future win in the primary game.

Figure 15:
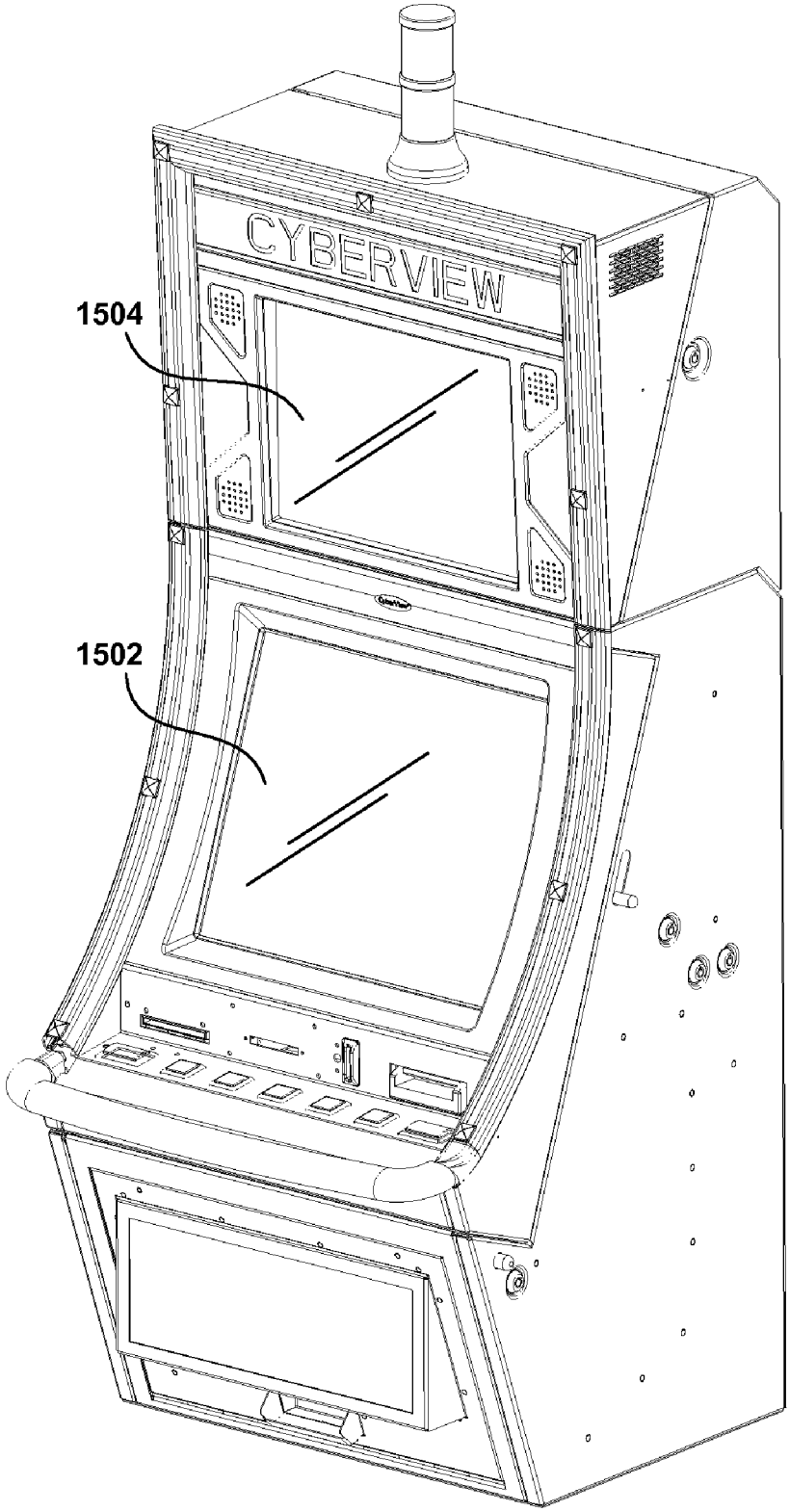
FIG. 15 shows a two-display gaming machine on which embodiments of the present invention may be practiced.

As shown in FIGS. 15 and 16, the primary game on which the cashless time game session is played may be displayed on a first display 1502 and the additional wagering opportunity may be displayed on a second display 1504. Alternatively, the additional wagering opportunity may simply overlay the primary game, displayed within the same display. In the example of FIGS. 15 and 16, the gaming machine includes two displays. Further details of the gaming machine of FIGS. 15 and 16 may be seen in co-pending and commonly assigned U.S. design patent application Ser. No. 29/233,830, which application is also hereby incorporated by reference in its entirety. As shown in FIG. 16, the primary game of the current cashless time game session may be, for example, a video poker game. During the cashless time game session, the gaming machine may provide the player with additional wagering opportunities that may be based upon the current context or state of the on-going game. In the example shown in FIG. 16, the additional wagering opportunity is based upon the current face-down state of the cards. In this example, therefore, the current face-down state of the cards is the context that triggers the offering of the additional betting opportunity shown in the display 1504. In this example, the additional wagering opportunity of FIG. 16 allows the player to bet on whether the face value of the cards yet to be turned over will exceed 25. The player, to avail himself/herself of this additional betting opportunity, must affirmatively press the "Bet" button. If the player does nothing or presses the "No Bet" button, no wager will be placed on whether the face value of the cards will exceed 25. Note that the timer of the primary game, shown at 1602, may be stopped while the additional betting opportunity is active or may continue unimpeded, with consequent effect upon the wager factor.

As discussed above and as shown relative to FIG. 16, the additional wagering opportunity may be contextually driven, with the context being derived from the primary game; that is, from the current cashless time game session. Alternatively, the context driving the timing of when the additional wagering opportunity appears, as well as the nature of the additional wagering opportunity may originate from outside of the primary game and/or even from outside of the gaming machine itself, subject to applicable gaming regulations. For example, the additional wagering opportunity may be linked to a progressive jackpot on neighboring gaming machines, thereby affording to player to participate in such games also, during his or her game play of the primary game during the current cashless time game session. Therefore, although the additional betting opportunity may be contextually driven, the context that drives it need not be that of the primary game. The additional wagering opportunity may specify the amount the player is allowed to bet (in the exemplary case shown in FIG. 16, that amount is $5) or may allow the player the flexibility of choosing the amount of the additional wager. The wager may be a flat amount (e.g., $5), or may be multiplied by the above-described wager factor (which reflects the wager that is applied per unit of time and which may grow as the time between successive wagers increases) or otherwise affected by the intermission. In turn, the wager factor or intermission may be that of the primary game or may be a wager factor or intermission computed solely from and for the additional wagering opportunity. Therefore, the additional wagering opportunities may themselves form another cashless time game session.

The additional wagering opportunity shown in the second display 1504 may persist for a predetermined period of time. In that case, an additional wagering opportunity timer 1604 may countdown the remaining time during which the player may make up his or her mind whether to participate or decline to participate in this additional betting opportunity. Alternatively still the additional betting opportunity may persist for as long as the event or condition in the primary game warrants it. That is, in the case of video poker, the additional wagering opportunity to bet on whether the face value of the cards will exceed 25 may be withdrawn only after one or more cards are turned over. Alternatively, the additional betting opportunity may be updated according to the face value of the card that was turned face up. Likewise, in the case of a car race, the additional wagering opportunity that the next car to pass the player's car will be blue would no longer be available when the color of the next passing car is revealed to the player. Therefore, the timing of the appearance, the nature of and the disappearance of the additional wagering opportunity may be contextually driven by what is currently happening in the primary game, in the gaming machine or dependent upon events or conditions prevailing external to the player's gaming machine, to the extent allowed under prevailing gaming regulations.

The context that drives the offering of one or more additional wagering opportunities need not be a single event that occurs within the primary game, such as the video poker game shown in FIG. 16. In fact, the player's performance may be analyzed over time and an additional wagering opportunity may be crafted in a dynamic fashion, based upon the results of the analysis of the player's behavior and/or performance. Such data may be combined with player data keyed to the player's loyalty card to offer even richer and personalized additional wagering opportunities that are unique to the player.

Figure 17:
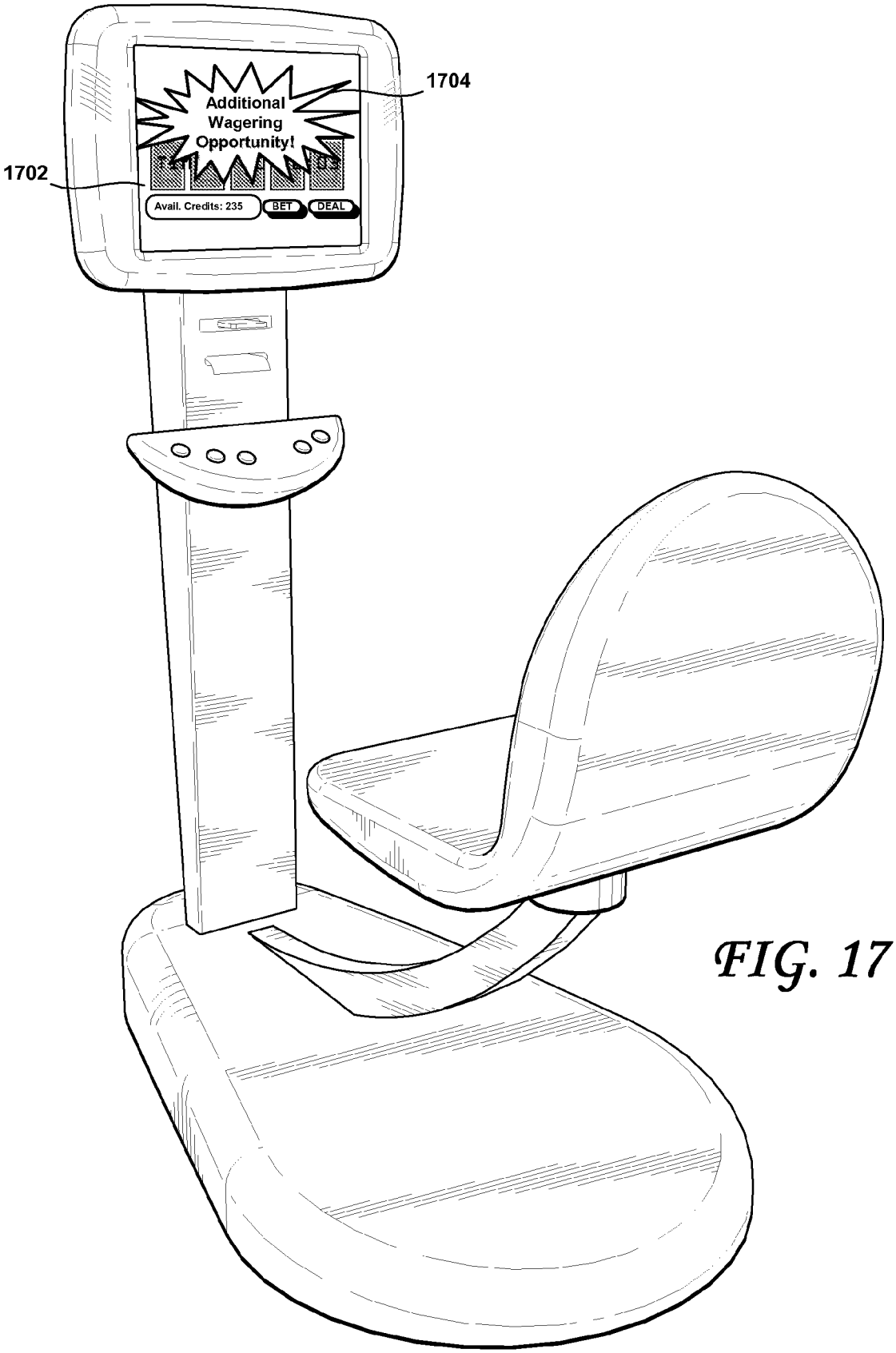
FIG. 17 shows an example of a single-seat single display gaming machine on which embodiments of the present invention may be practiced.

As shown in FIG. 17, the additional wagering opportunity may be displayed on the same display 1502 as is the primary game. For example, the additional wagering opportunity may be displayed on the (e.g., single) display 1702 of the gaming machine as a pop-up window, as shown at 1704. The appearance of the additional wagering opportunity may be preceded, accompanied and/or followed by any number of player-perceptible effects, such as graphic effects, sound, vibrations, etc., all designed to heighten the player's interest and excitement. As shown, the pop-up window announcing and/or containing the additional wagering opportunity may become more transparent over time, until such time as it disappears from the player's view altogether, at which point the player may not avail him or herself of the additional betting opportunity.

In narrative based games of chance, richly rendered virtual environments are presented to the player. Such rich environments offer a wide variety of additional wagering opportunities, as most any happening or artifact in the environment may be used as the basis of an additional wagering opportunity. For example, in a medieval dragon-slaying game of chance, the player might be invited to place a wager on whether the dragon's fire breath will incinerate a bunny rabbit shown frolicking nearby—decidedly not a major thematic element in the valiant Prince's dragon slaying quest. The frequency of additional wagering opportunities offered to the player may be selected such they do not unduly fragment the primary game play. According to further embodiments, the frequency with which such additional wagering opportunities present themselves to the player may be adaptive. That is, if the player consistently chooses not to avail him or herself of the offered additional wagering opportunities, such opportunities may present themselves at increasingly infrequent intervals, and may eventually not be presented to the player any more, if it is determined that the player is not interested in pursuing such additional wagering opportunities, preferring to concentrate on the primary game play, as evidenced by the player's past behavior.

Figure 18:
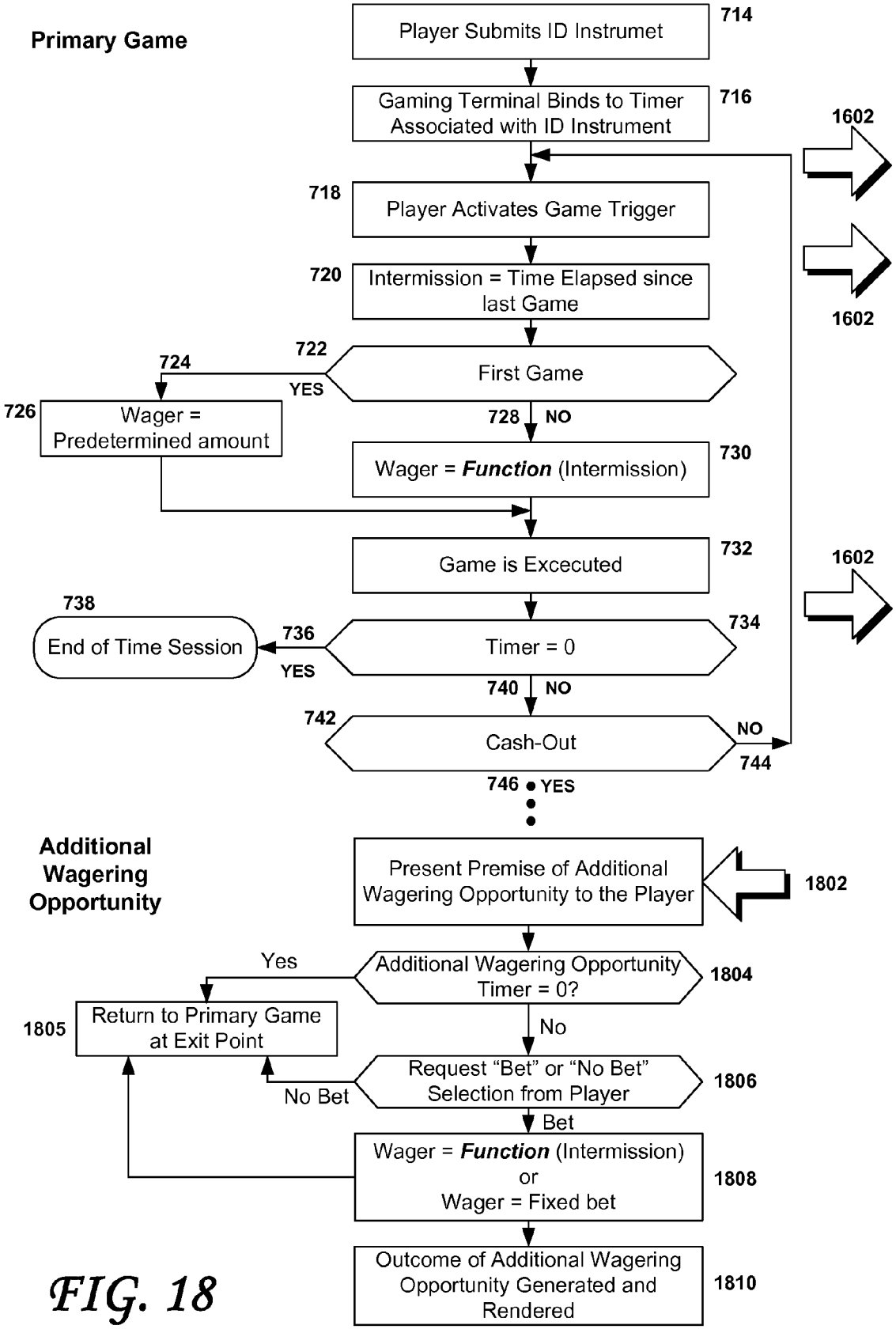
FIG. 18 is a flowchart illustrating further aspects of embodiments of the present invention.

FIG. 18 is a flowchart illustrating additional features of embodiments of the present invention. As shown therein, steps 714 to 744 are duplicated from the flowchart of FIG. 7 and the description thereof is omitted. As shown at 1802, at various points during game play, additional wagering opportunities may be offered to the player. For example, such additional wagering opportunities may be present to the player before the player activates the game trigger 716, after the player activates the game trigger 716 or after game execution but before the timer of the current cashless time game session. Such points 1802 at which the player is offered an additional wagering opportunity may be called "exit points." According to embodiments of the present invention, whether or not the player avails him or herself of the additional wagering opportunity, game play may thereafter resume from the exit point from the additional wagering opportunity was offered, without loss of continuity or context in the primary game, as shown at 1805 in FIG. 18. According to other embodiments, the player may be returned to the primary game at some other point in the game. Such may be the case, for example, in which the additional wagering opportunity offers the player an alternate route (or strategy) through the game narrative, in addition to an opportunity to bet on some aspect of the alternate route. In that case, it will be expected that the player will be returned to the primary game at some point other that at the exit point from which the additional wagering opportunity was offered.

According to further embodiments, the primary game timer (see step 734) may be halted for the duration necessary to offer and act upon the additional wagering opportunity, so as not to affect the value of the intermission. According to other embodiments, the primary game timer 734 is unaffected by the detour the player takes by availing him or herself of the offered additional wagering opportunity or opportunities, which does, by definition, affect the intermission and the wager, which is a function of the intermission (see step 740) in the current cashless time game session.

As shown in FIG. 18, from any of the exit points 1802, the player may be presented within an additional wagering opportunity, and the premise thereof (e.g., will the dragon's breath incinerate the bunny rabbit frolicking in the nearby meadow?) set out for the player's consideration. As shown at 1804, it is determined whether the additional wagering opportunity timer is equal to zero (or has otherwise timed out). For example, the user may be given a predetermined period of time, such as 10 seconds, to decide whether to bet or to pass on the offered additional betting opportunity. If the additional wagering opportunity timer has not timed out yet, the player may be requested to choose whether to bet or to not bet on the offered additional wagering opportunity, as shown at 1806. If, however, the additional wagering opportunity timer has reached zero or has otherwise timed out, step 1805 calls for the player to be returned to the primary game at the exit point (or to some other point, according to the game's script). As shown at 1808, the wager of the additional wagering opportunity is calculated, either as a function of the intermission (as a function of the time elapsed since last game or bet) or as a fixed (gaming machine determined: "Bet $5?" or "No Bet") or alternatively still as a player determined bet (e.g., player places a $1 chip token on the "Bet" button). Chip based gaming machines and methods, of the type in which a player places a chip token of a predetermined value on a betting opportunity, are disclosed in co-pending and commonly assigned U.S. patent application Ser. No. 11/409,722, which application is also hereby incorporated herein in its entirety. The outcome of the additional wagering opportunity may then be randomly generated and rendered to the gaming machine's display(s). This outcome need not be displayed immediately, but may instead be woven into the primary game's narrative. The player's available credits may then be credited or debited, according to whether the wagered outcome occurred or not, in known fashion.

While the foregoing detailed description has described preferred embodiments of the present invention, it is to be understood that the above description is illustrative only and not limiting of the disclosed invention. Those of skill in this art will recognize other alternative embodiments and all such embodiments are deemed to fall within the scope of the present invention. Thus, the present invention should be limited only by the claims as set forth below.

What is claimed is:

1. A method for enabling game play on a gaming machine, comprising the steps of:

modifying an existing console-type game or arcade-type game such that a plurality of wagering opportunities arise during the course of game play, the arising of the wagering opportunities being dependent upon the player's skill;

activating a game session on the gaming machine with a credit of playing time, the game session enabling the player to play the modified console-type game or arcade-type game for an amount of time determined by the credit of playing time;

enabling the player to place a bet on at least one of the plurality of wagering opportunities during the game play;

determining, by the gaming machine, an elapsed time since a last bet was placed by the player, determining and setting, by the gaming machine, an amount of the bet, the amount of the bet being determined at least partially dependent upon the determined elapsed time, such that a shorter determined lapsed time results in the gaming machine setting a smaller amount for the bet than does a comparatively longer determined elapsed time, and randomly determining an outcome of the placed bet.

2. The method of claim 1, wherein an outcome amount of the placed bet is dependent upon the determined elapsed time.

3. The method of claim 1, wherein the amount of the bet is debited from a credit account credited from a selected one of a cash acceptor, a cashless ticket-in reader, a bonus awarded and credits won in the course of a time game.

4. The method of claim 1, wherein the enabling step further comprises a step of receiving input from the player, the received input from the player indicating whether the player wishes to place the bet or wishes to decline to place the bet.

5. The method of claim 1, wherein the bet is placed automatically by the gaming machine in an amount that is dependent upon the determined elapsed time since the last bet was placed.

6. The method of claim 1, wherein the enabling step enables the player to place the bet until a timeout period has elapsed.

7. The method of claim 6, wherein the timeout period is selected by the player.

8. The method of claim 1, wherein the game session terminates when the credit of playing time is exhausted.

9. The method of claim 1, wherein any remaining credit of playing time is frozen when the player causes a cash-out event.

10. The method of claim 1, wherein the modifying step includes adding wagering opportunities for selected ones of game events that would otherwise cause points to be awarded or taken away during game play.

11. The method of claim 1, wherein the modifying step is carried out with the existing game console-type being a game configured for game play on a game console selected from the group consisting of a Sony game console, a Microsoft game console, and a Nintendo game console.

12. The method of claim 1, wherein the game session activating step is carried out with the game session enabling a plurality of players to play the modified console-type game or arcade-type game in a multi-player mode.

13. The method of claim 12, wherein the game session of respective ones of the plurality of players lasts for an amount of time determined by respective credits of playing time of the plurality of players.

14. The method of claim 12, wherein the enabling step includes a step of requiring the player to confirm whether the player wishes to place the bet or wishes to decline to place the bet.

15. The method of claim 1, wherein the modifying step is carried out with the existing console-type game or arcade-type game being an at least partially skill-based game.

16. A method for enabling game play on a gaming machine, comprising the steps of:

configuring a skill-based game such that a plurality of wagering opportunities arise during the course of game play, the arising of the wagering opportunities being dependent upon the player's skill;

activating a game session on the gaming machine with a credit of playing time, the game session enabling the player to play the skill-based game for an amount of time determined by the credit of playing time;

enabling the player to place a bet on at least one of the plurality of wagering opportunities during the game play;

determining, by the gaming machine, an elapsed time since a last bet was placed by the player, determining and setting, by the gaming machine, an amount of the bet, the amount of the bet being determined at least partially dependent upon the determined elapsed time, such that a shorter determined lapsed time results in the gaming machine setting a smaller amount for the bet than does a comparatively longer determined elapsed time, and randomly determining an outcome of the placed bet.

17. The method of claim 16, wherein an outcome amount of the placed bet is dependent upon the determined elapsed time.

18. The method of claim 16, wherein the amount of the bet is debited from a credit account credited from a selected one of a cash acceptor, a cashless ticket-in reader, a bonus awarded and credits won in the course of a time game.

19. The method of claim 16, wherein the enabling step further comprises a step of receiving input from the player, the received input from the player indicating whether the player wishes to place the bet or wishes to decline to place the bet.

20. The method of claim 16, wherein the bet is placed automatically by the gaming machine in an amount that is dependent upon the determined elapsed time since the last bet was placed.

21. The method of claim 16, wherein the enabling step enables the player to place the bet until a timeout period has elapsed.

22. The method of claim 21, wherein the timeout period is selected by the player.

23. The method of claim 16, wherein the game session terminates when the credit of playing time is exhausted.

24. The method of claim 16, wherein any remaining credit of playing time is frozen when the player causes a cash-out event.

25. The method of claim 16, wherein the configuring step includes adding wagering opportunities for selected ones of game events that would otherwise cause points to be awarded or taken away during game play of the skill-based game.

26. The method of claim 16, wherein the configuring step is carried out with the skill-based game being a game configured for game play on a game console selected from the group consisting of a Sony game console, a Microsoft game console, and a Nintendo game console.

27. The method of claim 16, wherein the game session activating step is carried out with the game session enabling a plurality of players to play the skill based game in a multi-player mode.

28. The method of claim 27, wherein the game session of respective ones of the plurality of players lasts for an amount of time determined by respective credits of playing time of the plurality of players.

29. The method of claim 16, wherein the enabling step includes a step of requiring the player to confirm whether the player wishes to place the bet or wishes to decline to place the bet.

30. A gaming machine, comprising:

a modified existing console-type game or arcade-type game, configured such that a plurality of wagering opportunities arise during the course of game play, the arising of the waging opportunities being dependent upon the player's skill;

a computer configured to activate a game session with a purchased credit of playing time, to run the modified existing console-type game or arcade-type game, to enable player interactivity with the modified existing console-type game or arcade-type game and to enable a player to place at least one bet as the wagering opportunities arise during game play of the modified existing console-type game or arcade-type game, the computer being further configured to determine an elapsed time since a last bet was placed by the player and to determine and set an amount of the bet, the amount of the bet being determined at least partially dependent upon the determined elapsed time, such that a shorter determined lapsed time results in the computer setting a smaller amount for the bet than does a comparatively longer determined elapsed time;

a random outcome generator configured to randomly determine an outcome of the placed bet, and a timer configured to determine a remaining amount of the credit of playing time, the game session ending when the remaining amount of the credit of playing time is exhausted.

31. The gaming machine of claim 30, wherein the existing console-type game or arcade-type game is modified such that the plurality of wagering opportunities arise when selected game events occur that would otherwise cause points to be awarded or taken away during game play of the existing console-type or arcade-type game.

32. The gaming machine of claim 30, wherein an outcome amount of the place bet is dependent upon the determined elapsed time.

33. The gaming machine of claim 30, wherein the amount of the bet is debited from a credit account credited from a selected one of a cash acceptor, a cashless ticket-in reader, a bonus awarded and credits won in the course of a time game.

34. The gaming machine of claim 30, wherein the modified existing console-type game or arcade-type game is configured to receive input from the player, the received input from the player indicating whether the player wishes to place the bet or wishes to decline to place the bet.

35. The gaming machine of claim 34, wherein the computer is further configured such that the enabling step enables the player to place the bet until a timeout period has elapsed.

36. The gaming machine of claim 35, wherein the timeout period is selected by the player.

37. The gaming machine of claim 30, wherein the modified existing console-type game or arcade-type game is configured to automatically place the at least one bet in an amount that is dependent upon the determined elapsed time.

38. The gaming machine of claim 30, wherein the modified existing console-type game or arcade-type game is configured to enable the player to place at least one bet in an amount that is pre-selected by the player.

39. The gaming machine of claim 30, wherein the modified existing console-type game or arcade-type game is a game configured for game play on a game console selected from the group consisting of a Sony game console, a Microsoft game console, and a Nintendo game console.

40. The gaming machine of claim 30, wherein the modified existing console-type game or arcade-type game is a game configured for multi-player gaming and wherein the game session the game session is configured to enable a plurality of players to play the modified console-type game or arcade-type game in a multi-player mode.

41. The gaming machine of claim 40, wherein the game session of respective ones of the plurality of players lasts for an amount of time determined by respective credits of playing time of the plurality of players.

42. The gaming machine of claim 30, wherein the modified existing console-type game or arcade-type game is configured to require the player to confirm whether the player wishes to place the bet or wishes to decline to place the bet.

43. The gaming machine of claim 42, wherein the bet is automatically declined after a timeout period.

44. The gaming machine of claim 43, wherein the timeout period is selected by the player.

45. The gaming machine of claim 30, wherein the modified existing console-type game or arcade-type game is configured as an at least partially skill-based game.

46. The gaming machine of claim 30, wherein the random outcome generator includes a random number generator within the gaming machine.

47. The gaming machine of claim 30, wherein the random outcome generator includes a network connection for receiving game outcomes from a server coupled to a network.

48. A gaming machine, comprising:

a skill-based game configured such that a plurality of wagering opportunities arise during the course of game play, the arising of the wagering opportunities being dependent upon the player's skill;

a computer configured to enable a game session with a purchased credit of playing time, to run the skill-based game, to enable player interactivity with the skill-based game and to enable a player to place at least one bet when the wagering opportunities arise during game play of the skill-based game, an amount of the at least one placed bet is at least partly dependent upon a time elapsed since a last bet was placed;

a computer configured to activate a game session with a purchased credit of playing time, to run the skill-based game, to enable player interactivity with the skill-based game and to enable a player to place at least one bet as the wagering opportunities arise during game play of the skill-based game, the computer being further configured to determine an elapsed time since a last bet was placed by the player and to determine and set an amount of the bet, the amount of the bet being determined at least partially dependent upon the determined elapsed time, such that a shorter determined lapsed time results in the computer setting a smaller amount for the bet than does a comparatively longer determined elapse time;

a random outcome generator configured to determine an outcome of the placed bet, and a timer configured to determine a remaining amount of the credit of playing time, the game session ending when the remaining amount of the credit of playing time is exhausted.

49. The gaming machine of claim 48, wherein the skill-based game is modified such that the plurality of wagering opportunities arise as selected game events occur that would otherwise cause points to be awarded or taken away during game play of the skill-based game.

50. The gaming machine of claim 48, wherein an outcome amount of the placed bet is dependent upon the determined elapsed time.

51. The gaming machine of claim 48, wherein the amount of the bet is debited from a credit amount credited from a selected one of a cash acceptor, a cashless ticket-in reader, a bonus awarded and credits won in the course of a time game.

52. The gaming machine of claim 48, wherein the skill-based game is configured to receive input from the player, the received input from the player indicating whether the player wishes to place the bet or wishes to decline to place the bet.

53. The gaming machine of claim 52, wherein the computer is configured such that the bet is automatically declined after a timeout period.

54. The gaming machine of claim 53, wherein the timeout period is player selectable.

55. The gaming machine of claim 48, wherein the skill-based game is configured to automatically place the at least one bet in an amount that is dependent upon the determined.

56. The gaming machine of claim 48, wherein the skill-based game is configured to enable the player to place at least one bet in an amount that is pre-selected by the player.

57. The gaming machine of claim 56, wherein the amount of the bet pre-selected by the player is debited from a credit account credited from a selected one of a cash acceptor, a cashless ticket-in reader, a bonus awarded and credits won in the course of a time game.

58. The gaming machine of claim 56, wherein the game session of respective ones of the plurality of players lasts for an amount of time determined by respective credits of playing time of the plurality of players.

59. The gaming machine of claim 48, wherein the skill-based game is a game configured for game play on a game console selected from the group consisting of a Sony game console, a Microsoft game console, and a Nintendo game console.

60. The gaming machine of claim 48, wherein the skill-based game is a game configured for multi-player gaming and wherein the game session the game session is configured to enable a plurality of players to play the skill-based game in a multi-player mode.

61. The gaming machine of claim 48, wherein the skill-based game is configured to require the player to confirm whether the player wishes to place the bet or wishes to decline to place the bet.

62. The gaming machine of claim 61, wherein the computer is further configured such that the bet is automatically declined after a timeout period.

63. The gaming machine of claim 62, wherein the timeout period is selected by the player.

64. The gaming machine of claim 48, wherein the random outcome generator includes a random number generator within the gaming machine.

65. The gaming machine of claim 48, wherein the random outcome generator includes a network connection for receiving game outcomes from a server coupled to a network.

66. A method for enabling game play on a gaming machine, comprising the steps of:

activating a game session on the gaming machine with a credit of playing time, the game session enabling the player to play a primary game of chance for an amount of time determined by the credit of playing time;

enabling primary wagers to be placed on the primary game during the game session;

for each primary wager placed and won, determining an amount of credits due to the player as a function of an elapsed time since a previous primary wager was placed during the game session such that a shorter elapsed time results in the gaming machine determining a smaller amount of credits due to the player for each primary wager placed and won than does a comparatively longer elapse time;

occasionally halting game play on the primary game upon occurrence of a predetermined event within the primary game and offering one or more contextually driven additional wagering opportunities of limited duration, and re-enabling game play on the primary game when the limited duration has elapsed or when the player has availed him or herself of the additional gaming opportunity.

67. The method of claim 66, wherein the credit of playing time is controlled by a down-counting timer and wherein the method further includes ending the game session when the down-counting timer reaches a predetermined number.

68. The method of claim 66, wherein the credit of playing time is controlled by an up-counting timer and wherein the method further includes ending the game session when the up-counting timer reaches a predetermined number.

69. The method of claim 66, wherein the game session terminates when the credit of playing time is exhausted.

70. The method of claim 66, wherein any remaining credit of playing time is frozen when game play on the primary game is halted and unfrozen when game play on the primary game is re-enabled.

71. The method of claim 66, wherein any remaining credit of playing time continues to decrement when game play on the primary game is halted and when play on the primary game is re-enabled.

72. The method of claim 66, wherein any remaining credit of playing time is frozen when the player causes a cash-out event.

73. The method of claim 66, wherein the additional wagering opportunity is offered more infrequently each time the player declines to avail him or herself of the offered additional wagering opportunity.

74. The method of claim 66, wherein the primary game play is re-enabled as of a point where the primary game play was halted to offer the additional waging opportunity.

75. The method of claim 66, wherein the primary game play is re-enabled at a different point in the primary game than where the primary game was halted to offer the additional wagering opportunity.

76. The method of claim 66, wherein the contextually driven additional wagering opportunities offered are dependent upon a state of the primary game as of a time when game play on the primary game is halted.

77. The method of claim 66, further including a step of offering at least one contextually driven additional wagering opportunity when one or more predetermined events occur external to the gaming machine.

78. The method of claim 66, further comprising an initial step of dispensing to the player an ID instrument associated with the amount of playing time purchased by the player, the ID instrument being submitted to the gaming machine to activate the game session.

79. The method of claim 66, wherein the offering step is configured to offer to the player one or more contextually driven additional wagering opportunities that are structured based upon player data associated with a loyalty card of the player.

80. The method of claim 66, wherein the offering step is configured to offer to the player one or more contextually driven additional wagering opportunities that are structured based upon at least one of a past performance and behavior of the player.

81. A method for a player to wager on a gaming machine, comprising the step of:

activating a game session on the gaming machine with a credit of playing time, the game session enabling the player to play primary games of chance for an amount of time determined by the credit of playing time;

enabling successive primary games to be triggered during the game session;

determining and setting an amount of the wager for each game played during the game session as a function of an elapsed time since a triggering of a previous game played during the game session such that a shorter elapsed time results in the gaming machine setting a smaller amount for the wager than does a comparatively longer elapsed time;

occasionally halting game play of a primary game being played upon occurrence of a predetermined event within the primary game and offering to the player one or more contextually driven additional wagering opportunities of limited duration, and re-enabling game play on the primary game when the limited duration has elapsed or when the player has availed him or herself of the additional gaming opportunity.

82. The method of claim 81, wherein the credit of playing time is controlled by a down-counting timer and wherein the method further includes ending the game session when the down-counting timer reaches a predetermined number.

83. The method of claim 81, wherein the credit of playing time is controlled by an up-counting timer and wherein the method further includes ending the game session when the up-counting timer reaches a predetermined number.

84. The method of claim 81, wherein the game session terminates when the credit of playing time is exhausted.

85. The method of claim 81, wherein any remaining credit of playing time is frozen when game play on the primary game is halted and unfrozen when game play on the primary game is re-enabled.

86. The method of claim 81, wherein any remaining credit of playing time continues to decrement when game play on the primary game is halted and when play on the primary game is re-enabled.

87. The method of claim 81, wherein any remaining credit of playing time is frozen when the player causes a cash-out event.

88. The method of claim 81, wherein the additional wagering opportunity is offered more infrequently each time the player declines to avail him or herself of the offered additional wagering opportunity.

89. The method of claim 81, wherein the primary game play is re-enabled as of a point where the primary game play was halted to offer the additional wagering opportunity.

90. The method of claim 81, wherein the primary game play is re-enabled at a different point in the primary game than where the primary game was halted to offer the additional wagering opportunity.

91. The method of claim 81, wherein the contextually driven additional wagering opportunities offered are dependent upon a state of the primary game as of a time when game play on the primary game is halted.

92. The method of claim 81, further comprising an initial step of dispensing to the player an ID instrument associated with the amount of playing time purchased by the player, the ID instrument being submitted to the gaming machine to activate the game session.

93. The method of claim 81, wherein the offering step is configured to offer to the player one or more contextually driven additional wagering opportunities that are structured based upon player data associated with a loyalty card of the player.

94. The method of claim 81, wherein the offering step is configured to offer to the player one or more contextually driven additional wagering opportunities that are structured based upon at least one of a past performance and behavior of the player.

* * * * *